US010022284B2

(12) United States Patent
Yamada et al.

(10) Patent No.: US 10,022,284 B2
(45) Date of Patent: Jul. 17, 2018

(54) LIFE ASSISTANCE SYSTEM FOR ASSISTING USER IN ACT OF STANDING UP

(71) Applicant: Panasonic Corporation, Osaka (JP)

(72) Inventors: Kazunori Yamada, Aichi (JP); Mayu Yokoya, Tokyo (JP); Hidetsugu Maekawa, Nara (JP); Yoji Yamada, Aichi (JP); Pei Di, Aichi (JP)

(73) Assignee: PANASONIC CORPORATION, Osaka (JP)

( * ) Notice: Subject to any disclaimer, the term of this patent is extended or adjusted under 35 U.S.C. 154(b) by 71 days.

(21) Appl. No.: 15/234,808

(22) Filed: Aug. 11, 2016

(65) Prior Publication Data

US 2017/0056262 A1 Mar. 2, 2017

(30) Foreign Application Priority Data

Aug. 25, 2015 (JP) ..... 2015-165989
May 25, 2016 (JP) ..... 2016-104457

(51) Int. Cl.
*A61G 5/14* (2006.01)
*A61G 7/10* (2006.01)

(52) U.S. Cl.
CPC ..... *A61G 5/14* (2013.01); *A61G 7/1038* (2013.01); *Y10S 901/01* (2013.01)

(58) Field of Classification Search
None
See application file for complete search history.

(56) References Cited

U.S. PATENT DOCUMENTS 5,984,411 A * 11/1999 Galumbeck ..... A61G 5/14 297/330
8,856,981 B1 * 10/2014 Rayess ..... A61G 7/1011 5/83.1
9,713,559 B2 * 7/2017 Hough ..... A61G 5/14
2006/0277074 A1 * 12/2006 Einav ..... G06F 19/322 705/3
2007/0169267 A1 * 7/2007 Paz ..... A61G 7/015 5/610
2007/0173380 A1 * 7/2007 Gabel ..... A61G 5/14 482/52
2008/0242521 A1 * 10/2008 Einav ..... A61B 5/103 482/110
2009/0300845 A1 * 12/2009 Paz ..... A61G 7/015 5/610
2010/0207354 A1 * 8/2010 Hunziker ..... A61G 5/14 280/304.1

(Continued)

FOREIGN PATENT DOCUMENTS

JP 2007-209704 8/2007

*Primary Examiner* — Ryan Rink
(74) *Attorney, Agent, or Firm* — Greenblum & Bernstein, P.L.C.

(57) ABSTRACT

A life assistance system includes an automatic liftable chair and an autonomous mobile robot connected to the automatic liftable chair via a network. The life assistance system assists a user in the action of standing up from the automatic liftable chair. The life assistance system is configured such that upon reception of a stand-up assist instruction by the autonomous mobile robot, the automatic liftable chair executes a first assisting action and that upon detection of a load applied to a handle of the autonomous mobile robot, the automatic liftable chair executes a second assisting action.

19 Claims, 35 Drawing Sheets

(56) References Cited

U.S. PATENT DOCUMENTS

| | | | | |
|---|---|---|---|---|
| 2014/0135981 | A1* | 5/2014 | Cooper | A61G 7/1017 700/245 |
| 2014/0265500 | A1* | 9/2014 | Hough | A61G 5/14 297/340 |
| 2014/0289960 | A1* | 10/2014 | Hjort | A61G 7/1019 5/83.1 |
| 2014/0338129 | A1* | 11/2014 | Mitchell | A47C 21/00 5/610 |
| 2015/0190293 | A1* | 7/2015 | Hacikadiroglu | A61G 7/1017 5/87.1 |
| 2015/0359694 | A1* | 12/2015 | Suzuki | A61G 7/1019 5/86.1 |
| 2016/0331618 | A1* | 11/2016 | Hood | A61G 7/1046 |
| 2017/0020754 | A1* | 1/2017 | Hyde | B60G 21/08 |
| 2017/0340495 | A1* | 11/2017 | Paul | A61G 5/14 |

* cited by examiner

SITTING POSITION

LIFE ASSISTANCE SYSTEM FOR ASSISTING USER IN ACT OF STANDING UP

BACKGROUND

1. Technical Field

The present disclosure relates to a life assistance system that includes an automatic liftable chair which has and moves a seat on which a user sits and that assists the user in the act of standing up from the automatic liftable chair.

2. Description of the Related Art

In recent years, life assistance technologies and nursing care support technologies have been developed as technologies for underpinning a rapidly aging society. Among them, the idea of extending the healthy life expectancies of the elderly has gained importance. Specifically, it has been considered important for a system or an apparatus to, instead of totally assisting an elderly person in a predetermined act, partially assist him/her in the predetermined act and thereby lead him/her to voluntary behavior. As such a technology, for example, a stand-up assist system that assists an elderly person in the act of standing up from a chair has been under study (for example, see Japanese Patent No. 4923605).

However, the system of Japanese Patent No. 4923605 is still under study and needs further improvements.

SUMMARY

One non-limiting and exemplary embodiment provides a life assistance system, a life assistance method, and an automatic liftable chair that can achieve further improvements.

In one general aspect, the techniques disclosed here feature a life assistance system including: an automatic liftable chair having and moving a seat on which a user sits; a load detection apparatus that detects a load applied by the user's hand or arm; and an instruction inputter that receives a stand-up assist instruction from the user, wherein the automatic liftable chair includes an assistance control apparatus that controls a movement of the seat to execute an assisting action of assisting the user, who is sitting on the automatic liftable chair, in standing up, in response to the assist instruction, the assistance control apparatus executes a first assisting action of moving the seat from a sitting position to a first seat position, and upon detection of the load, the assistance control apparatus executes a second assisting action of moving the seat from the first seat position to a second seat position.

The present disclosure makes it possible to achieve further improvements in a life assistance system, a life assistance method, and an automatic liftable chair.

It should be noted that general or specific embodiments may be implemented as a system, a method, an integrated circuit, a computer program, a storage medium, or any selective combination thereof.

Additional benefits and advantages of the disclosed embodiments will become apparent from the specification and drawings. The benefits and/or advantages may be individually obtained by the various embodiments and features of the specification and drawings, which need not all be provided in order to obtain one or more of such benefits and/or advantages.

Figure 1:
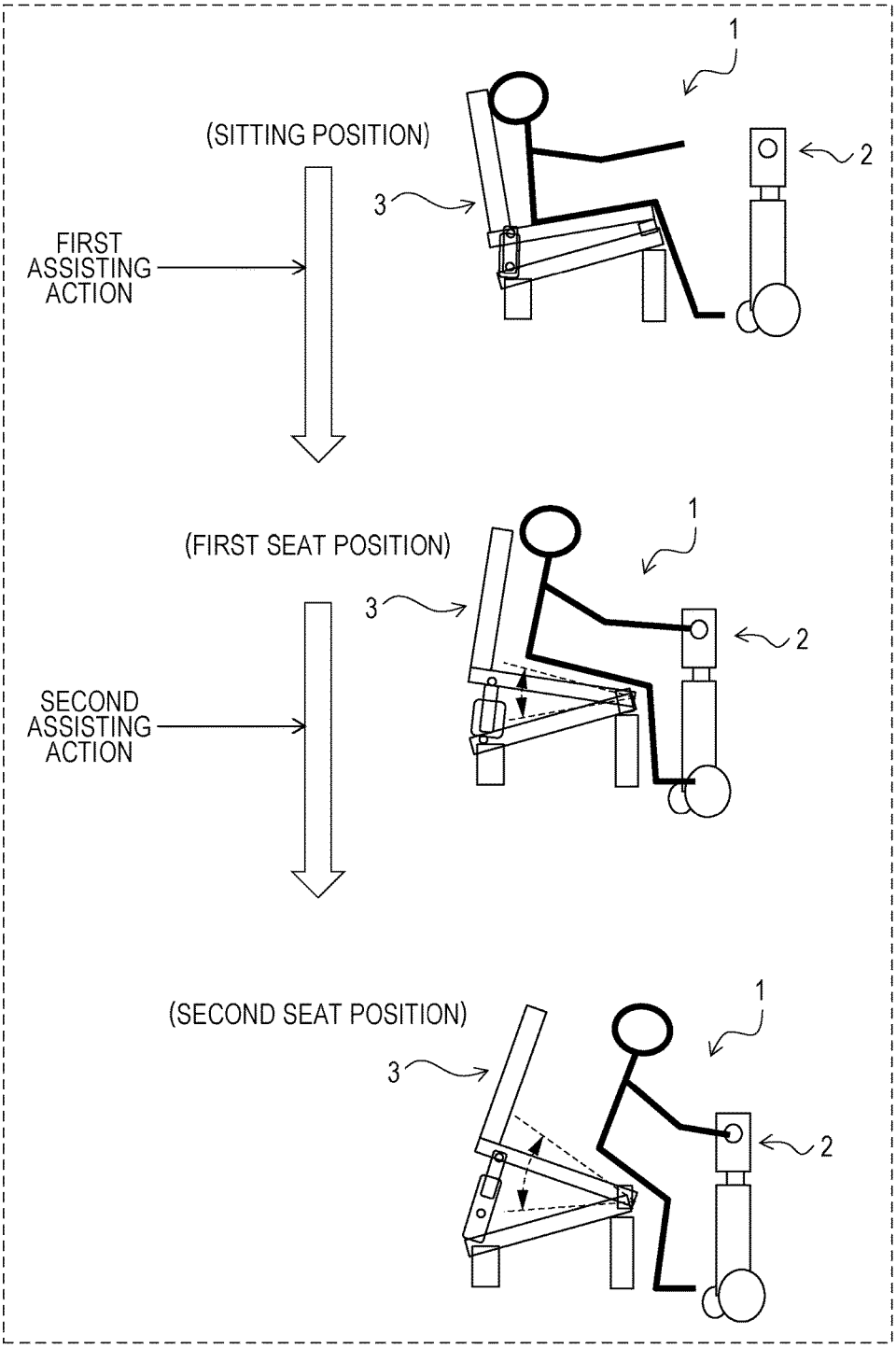
FIG. 1 is a schematic view showing the main components and main actions of a life assistance system according to Embodiment 1 of the present disclosure.

DETAILED DESCRIPTION (Underlying Knowledge Forming Basis of the Present Disclosure)

A system for assisting a user (e.g. an elderly person) in an act is enabled by three actuators provided in an electric wheelchair to automatically and separately perform the action of tilting the seat of the electric wheelchair, the action of tilting the backrest, and the action of extending and contracting the backrest (for example, see Japanese Patent No. 4923605).

The art disclosed in Japanese Patent No. 4923605 controls a reclining action of the electric wheelchair with an operating switch and an operating lever provided in the electric wheelchair, enabling the electric wheelchair to shift from a normal position to a stand-up position. However, since the electric wheelchair totally assists the user from a sitting state to a stand-up state, the user has no chance to use his/her muscle strength to perform the act of standing up. Therefore, continued use of assisting actions of the electric wheelchair of Japanese Patent No. 4923605 causes a continued decline in the user's muscle strength.

Further, the art disclosed in Japanese Patent No. 4923605 is configured such that the user operates the operating switch and the operating lever by him/herself to cause the electric wheelchair to execute the reclining action up to stand-up. Such a configuration forces the user to shift from the sitting state to the stand-up state in accordance with the movements of the seat and the backrest. Therefore, for example, the user, who is suffering from the decline of his/her bodily function, feels the fear of seeing him/her bodily movements being controlled by the apparatus.

To address these problems, the inventors studied to improve the functions of life assistance systems and finally proposed the following measures for improvement.

In a first aspect, a life assistance system includes: an automatic liftable chair having and moving a seat on which a user sits; a load detection apparatus that detects a load applied by the user's hand or arm; and an instruction inputter that receives a stand-up assist instruction from the user. The automatic liftable chair includes an assistance control apparatus that controls a movement of the seat to execute an assisting action of assisting the user, who is sitting on the automatic liftable chair, in standing up. In response to the assist instruction, the assistance control apparatus executes a first assisting action of moving the seat from a sitting position to a first seat position. Upon detection of the load, the assistance control apparatus executes a second assisting action of moving the seat from the first seat position to a second seat position.

According to the first aspect, in response to the assist instruction inputted to the instruction inputter, the assistance control apparatus executes the first assisting action of moving the seat of the automatic liftable chair from the sitting position to the first seat position, and upon detection of the load by the load detection apparatus, the assistance control apparatus executes the second assisting action of moving the seat from the first seat position to the second seat position.

Note here for example that in a case where the user voluntarily performs a stand-up action by using his/her hand or arm to apply a load to the load detection apparatus in an attempt to voluntarily stand up, the assistance control apparatus of the automatic liftable chair executes the second assisting action. This allows the user's to use his/her muscle strength at least at the start of the stand-up action, thus preventing the user from leaving his/her stand-up action solely to the actions of the automatic liftable chair. Use of the life assistance system according to the present aspect makes it possible to assist the user in the act of standing up and suppress a decline in the user's muscle strength.

Further, the inputting of the stand-up assist instruction causes the assistance control apparatus of the automatic liftable chair, for example, to execute the first assisting action to lift the user's body. After that, when the user's hand or arm applies a load to the load detection apparatus, the second assisting action is executed, for example, to shift the user's body from the state in which the body is lifted to a stand-up state. Therefore, when the user conveys his/her intention to stand up to the life assistance system and then executes the act of putting his/her own weight on the load detection apparatus, the stand-up assisting action is executed by the automatic liftable chair. This prevents the user's bodily movements from being controlled by the life assistance system, thus making it possible to reduce the mental burden on the user. Furthermore, when the second assisting action is executed, the user is putting part of his/her weight on the load detection apparatus. This allows the user to support his/her body even when the movements of the automatic liftable chair makes it easy to lose a balance, thus making it possible to reduce the mental burden on the user in this regard, too. For these reasons, the first aspect makes it possible to produce a sense of security in the user, as the automatic liftable chair performs the stand-up action at a stage where the user is mentally and physically prepared.

In the first aspect, for example, the load detection apparatus may be an autonomous mobile robot connected to the automatic liftable chair via a network. The autonomous mobile robot may include: a main body; a handle, provided on the main body, which the user is able to grip; a first load sensor that detects, as the load applied by the user's hand or arm, a load applied to the handle; and the instruction inputter.

In the first aspect, for example, the autonomous mobile robot may further include a first communicator that sends reception information and each piece of load detection information to the automatic liftable chair via the network, the reception information indicating that the stand-up assist instruction has been received, the load detection information indicating that the load has been detected. The automatic liftable chair may further include a second communicator that receives the reception information and the load detection information via the network. In a case where the reception information has been received by the second communicator, the assistance control apparatus may execute the first assisting action. In a case where the load detection information has been received by the second communicator, the assistance control apparatus may execute the second assisting action.

In the first aspect, for example, the automatic liftable chair may further include a second load sensor that detects a load applied to the seat. The assistance control apparatus may execute the second assisting action in a case where the load detection information has been received and in a case where a decrease in the load applied to the seat has been detected.

According to the first aspect, the automatic liftable chair executes the second assisting action by using load detection information from the first load sensor and load detection information from the second load sensor. This makes it possible to carry out the second assisting action after surely detecting a shift of the user's weight or center of gravity from the automatic liftable chair to the autonomous mobile robot. This in turn makes it possible to heighten the certainty of the second assisting action.

In the first aspect, for example, the autonomous mobile robot may further include: a moving apparatus that causes the main body to move in a self-supporting state; and a movement controller that controls a movement of the moving apparatus. Upon receiving the stand-up assist instruction via the instruction inputter, the movement controller may control the movement of the moving apparatus to cause the autonomous mobile robot to move to an assisting place in an area near a place that is in front of the automatic liftable chair.

According to the first aspect, in a case where the autonomous mobile robot has received the assist instruction, the movement controller of the autonomous mobile robot exercises control via the moving apparatus so that the autonomous mobile robot moves to a place that is in front of the automatic liftable chair. This allows the user to easily grip the handle of the autonomous mobile robot in an attempt to stand up.

In the first aspect, for example, the sitting position may be a seat position in which a front-back direction of the seat tilts toward the back of the automatic liftable chair with respect to a horizontal plane.

According to the first aspect, the sitting position of the automatic liftable chair is such that the front-back direction of the seat tilts toward the back of the automatic liftable chair with respect to the horizontal plane. This allows the user to adopt a reclining posture at a greater angle in the automatic liftable chair, thus making it possible to provide the user with more comfort.

In the first aspect, for example, the assisting action may include at least an action of changing a seat angle formed by a front-back direction of the seat and a vertical direction. The first assisting action may be an action of changing the seat angle from a steady seat angle corresponding to the sitting position to a first seat angle corresponding to the first seat position. The second assisting action may be an action of changing the seat angle from the first seat angle to a second seat angle corresponding to the second seat position. The first seat angle may be an angle that lies between the steady seat angle and the second seat angle.

The first aspect makes it possible to change the angle of the chair in two stages of action, thus making it possible to achieve seat control with a sense of security in the user.

Further, the seat angle can be gradually changed at least in two stages in the order of the steady seat angle, the first seat angle, and the second seat angle. This makes it possible to produce a sense of security in the user.

In the first aspect, for example, the automatic liftable chair may further include at least either a footrest on which the user puts his/her foot or a leg rest that guides the user's leg. The sitting position may be a seat position in which, when the user is using at least either the footrest or the leg rest, the user has his/her knee joint at an angle of greater than 90 degrees.

According to the first aspect, the automatic liftable chair includes at least either the footrest or the leg rest, and the sitting position is a seat position in which the user has his/her knee joint at an angle of greater than 90 degrees. This enables the user to maintain a very relaxed posture in a sitting state.

In the first aspect, for example, the assisting action may include at least an action of displacing the seat in a front-back direction of the automatic liftable chair. The first assisting action may an action of displacing the seat from the sitting position to the first seat position, the first seat position being closer to a front of the automatic liftable chair than the sitting position.

In the first aspect, for example, the automatic liftable chair may further include: a vital sign information sensor that detects vital sign information on the user sitting on the automatic liftable chair; and a degree-of-wakefulness determiner that determines a degree of wakefulness of the user on a basis of the vital sign information. The assistance control apparatus may control a speed of movement of the seat according to the degree of wakefulness.

According to the first aspect, the automatic liftable chair determines the degree of wakefulness of the user, who is sitting, and controls the speed of movement of the seat according to the degree of wakefulness. This allows the automatic liftable chair to execute the stand-up action in a way that is safer to the user.

In the first aspect, for example, the automatic liftable chair may further include: a vital sign information sensor that detects vital sign information on the user sitting on the automatic liftable chair; and a degree-of-fatigue determiner that determines a degree of fatigue of the user on a basis of the vital sign information. The assistance control apparatus may control a speed of movement of the seat according to the degree of fatigue.

According to the first aspect, the automatic liftable chair determines the degree of fatigue of the user, who is sitting, and controls the speed of movement of the seat according to the degree of fatigue. This allows the automatic liftable chair to execute the stand-up action in a way that is safer to the user.

In the first aspect, for example, in a case where the degree of wakefulness is less than a threshold, the assistance control apparatus may execute the first assisting action at a first seat movement speed. In a case where the degree of wakefulness is equal to or greater than the threshold, the assistance control apparatus may execute the second assisting action at a second seat movement speed. The first seat movement speed may be slower than the second seat movement speed.

In the first aspect, for example, in a case where the vital sign information has an intensity that takes on a predetermined value or larger, the assistance control apparatus may start to execute the first assisting action without receiving the reception information.

According to the first aspect, when the user shows a high level of vital sign information, (that is, the user is prepared to stand up from the automatic liftable chair), the first assisting action is executed regardless of the presence or absence of the reception information. This makes it possible to start the stand-up action at a timing appropriate for the user.

In the first aspect, for example, the automatic liftable chair may further include a voice outputter, and in a case where the degree of wakefulness is lower than a predetermined value and in a case where the first assisting action is being executed, the voice outputter may output a voice that induces the user into wakefulness.

According to the first aspect, in a case where the degree of wakefulness of the user is not sufficient and the first assisting action has already started, the voice can induce the user into wakefulness, thus making it possible to enhance the safety.

In the first aspect, for example, the automatic liftable chair may further include a time-of-action acquirer that acquires a time of action required to complete the first assisting action at a predetermined seat movement speed. The movement controller may calculate a route of movement and a time of movement to the assisting place. The first communicator may send time-of-movement information to the automatic liftable chair via the network, the time-of-movement information indicating the time of movement. Upon receiving the time-of-movement information via the second communicator, the assistance control apparatus may compare the time of movement with a first time of action required to complete the first assisting action at a first seat movement speed and, when the time of action is shorter than the time of movement, may execute the first assisting action at a second seat movement speed that is slower than the first seat movement speed. The second seat movement speed may be such a speed that a second time of action required to complete the first assisting action at the second seat movement speed is equal to the time of movement.

According to the first aspect, the automatic liftable chair controls the speed of movement of the first assisting action so that the time of movement required to move to the assisting place of the autonomous mobile robot and the second time of action required to complete the first assisting action become equal to each other. This makes it possible to shift from the first assisting action to the second assisting action in a way that is smooth for the user.

In the first aspect, for example, the movement controller may calculate a route of movement to the assisting place and a time of movement required to move through the route of movement. The automatic liftable chair may further include a time-of-action acquirer that acquires a time of action required to complete the first assisting action. The second communicator may send time-of-action information to the autonomous mobile robot via the network, the time-of-action information indicating the time of action. The movement controller may calculate a route of movement to the assisting place and a time of movement required to move through the route of movement at a predetermined speed of movement. Upon receiving the time-of-action information via the first communicator, the movement controller may compare the time of action with a first time of movement required to move through the route of movement at a first speed of movement and, when there is a difference between the time of action and the first time of movement, may cause the moving apparatus to move at a second speed of movement. The second speed of movement may be such a speed that a second time of movement required to move through the route of movement at the second speed of movement is equal to the time of action.

According to the first aspect, the autonomous mobile robot controls the speed of control movement so that the time of action required for the automatic liftable chair to complete the first assisting action and the time of movement become equal to each other. This makes it possible to shift from the first assisting action to the second assisting action in a way that is smooth for the user.

In the first aspect, for example, the autonomous mobile robot may further include a first light emitter provided in the main body. In a case where the first assisting action has been executed, the second communicator may send, to the autonomous mobile robot, a first command that causes the first light emitter to emit light.

According to the first aspect, upon receiving notification that the automatic liftable chair is carrying out the first assisting action, the autonomous mobile robot causes the first light emitter provided in the main body to emit light. This allows the user to recognize that the stand-up action will be performed very soon.

In the first aspect, for example, the autonomous mobile robot may further include a surface determiner that determines which surface of the main body faces the automatic liftable chair, a plurality of the first light emitters are provided on front and back surfaces, respectively, of the main body, and in a case where the first command has been received via the first communicator, light may be emitted by that one of the first light emitters which corresponds to a surface by which it is determined that the back surface of the main body faces the automatic liftable chair.

According to the first aspect, the autonomous mobile robot determines whether the front surface or the back surface faces the liftable chair and, in a case where the back surface faces the liftable chair, causes that one of the light emitters which is provided on the back surface to emit light. This allows the user to recognize that the autonomous mobile robot is in a walk assist state.

In the first aspect, for example, the autonomous mobile robot may further include a second light emitter provided in the handle. In a case where the first assisting action has been completed, the second communicator may send, to the autonomous mobile robot, a second command that causes the second light emitter to emit light.

According to the first aspect, in a case where the autonomous mobile robot has completed the first assisting action, the autonomous mobile robot causes the second light emitter provided in the handle to emit light. This allows the user to easily recognize the position where the handle is when he/she is supposed to grip the handle and the timing for gripping the handle.

Further, in a second aspect, an automatic liftable chair which is connected to an autonomous mobile robot via a network and which has and moves a seat on which a user sits includes: a communicator that receives reception information and load detection information from the autonomous mobile robot via the network, the reception information indicating that a stand-up assist instruction has been received, the load detection information indicating that a load applied to the autonomous mobile robot has been detected; and an assistance control apparatus that controls the seat to execute an assisting action of assisting the user, who is sitting on the automatic liftable chair, in standing up, wherein in a case where the reception information has been received by the communicator, the assistance control apparatus executes a first assisting action of moving the seat from a sitting position to a first seat position, and in a case where the load detection information has been received by the communicator, the assistance control apparatus executes a second assisting action of moving the seat from the first seat position to a second seat position.

According to the second aspect, on the basis of the assist instruction inputted to the autonomous mobile robot, the automatic liftable chair executes the first assisting action of moving the seat from the sitting position to the first seat position. After that, in accordance with the load detection information from the autonomous mobile robot, the automatic liftable chair moves the seat from the first seat position to the second seat position.

Note here for example that in a case where the user voluntarily performs a stand-up action by applying a load to the autonomous mobile robot in an attempt to voluntarily stand up, the automatic liftable chair executes the second assisting action. This allows the user's to use his/her muscle strength at least at the start of the stand-up action, thus preventing the user from leaving his/her stand-up action solely to the actions of the automatic liftable chair. Use of a life assistance system according to the second aspect makes it possible to assist the user in the act of standing up and suppress a decline in the user's muscle strength.

Further, the execution of the stand-up assist instruction causes the automatic liftable chair, for example, to execute the first assisting action to lift the user's body. After that, when the user applies a load to the autonomous mobile robot, the second assisting action is executed, for example, to shift the user's body from the state in which the body is lifted to a stand-up state. Therefore, when the user conveys his/her intention to stand up to the life assistance system and then executes the act of putting his/her own weight on the autonomous mobile robot, the stand-up assisting action is executed by the automatic liftable chair. This prevents the user's bodily movements from being controlled by the life assistance system, thus making it possible to reduce the mental burden on the user. Furthermore, when the second assisting action is executed, the user is putting part of his/her weight on the autonomous mobile robot. This allows the user to support his/her body even when the movements of the automatic liftable chair makes it easy to lose a balance, thus making it possible to reduce the mental burden on the user in this regard, too. For these reasons, the second aspect makes it possible to produce a sense of security in the user, as the automatic liftable chair performs the stand-up action at a stage where the user is mentally and physically prepared.

In the second aspect, for example, the autonomous mobile robot may include: a main body; a handle, provided on the main body, which the user is able to grip; and a first load sensor that detects a load applied to the handle. The load detection information may be information that is sent from the autonomous mobile robot to the automatic liftable chair in a case where the load has been detected by the first load sensor.

According to the second aspect, the user can apply a load by gripping the handle of the autonomous mobile robot. This allows the user to grip the handle of the autonomous mobile robot at least by the time the second assisting action is executed, thus makes it possible to prevent the user from losing a balance.

Further, in a third aspect, a life assistance method for use in an automatic liftable chair which is connected to an autonomous mobile robot via a network and which has and moves a seat on which a user sits includes: receiving reception information and load detection information from the autonomous mobile robot via the network, the reception information indicating that a stand-up assist instruction has been received, the load detection information indicating that a load applied to the autonomous mobile robot has been detected; controlling the seat to execute an assisting action of assisting the user, who is sitting on the automatic liftable chair, in standing up; upon receiving the reception information, executing a first assisting action of moving the seat from a sitting position to a first seat position; and upon receiving the load detection information, executing a second assisting action of moving the seat from the first seat position to a second seat position.

Embodiments of the present disclosure are described in detail below with reference to the drawings.

Embodiment 1

FIG. 1 is a schematic view showing the main components and main actions of a life assistance system in Embodiment 1 of the present disclosure. Embodiment 1 is directed to a life assistance system for assisting a user in standing up. The life assistance system includes an autonomous mobile robot 2 and an automatic liftable chair 3. The life assistance system is constituted by the autonomous mobile robot 2 and the automatic liftable chair 3 being connected to each other via a communication network. In Embodiment 1, in response to the inputting of a stand-up assist instruction from the user to the life assistance system with the user sitting in a sitting position of the automatic liftable chair 3, the automatic liftable chair 3 first performs the action of raising the seat from the sitting position to a first seat position. Next, upon detecting the holding of a handle of the autonomous mobile robot 2 by the user or the application of a load to the handle by the user, the automatic liftable chair 3 performs the action of rising to a second seat position.

Figure 2:
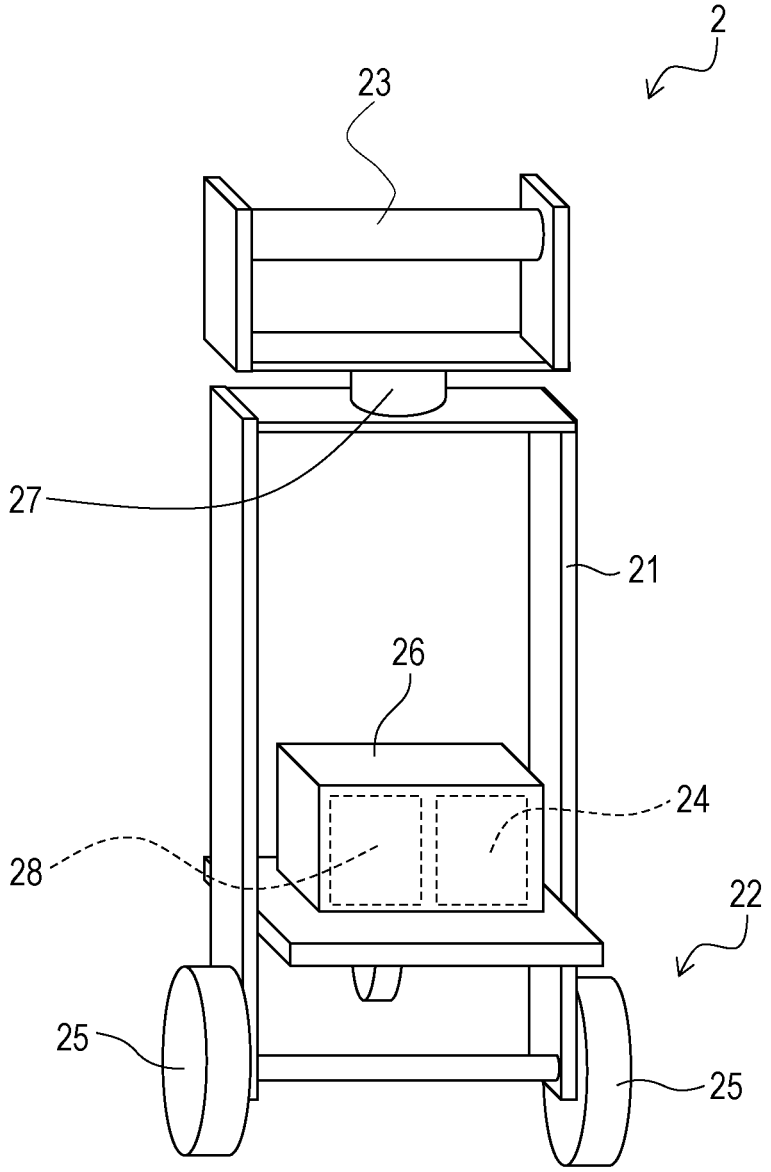
FIG. 2 is an appearance diagram of an autonomous mobile robot of Embodiment 1.
Figure 3:
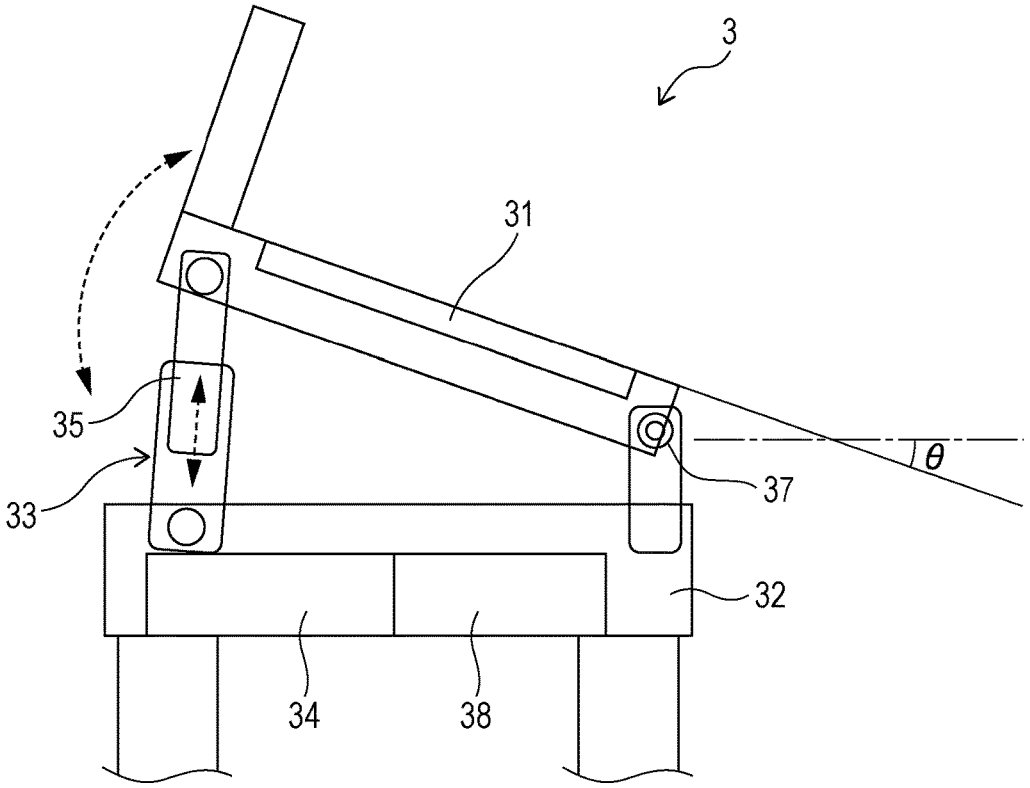
FIG. 3 is an appearance diagram of an automatic liftable chair of Embodiment 1.

Further, FIG. 2 is an appearance diagram of the autonomous mobile robot 2, and FIG. 3 is an appearance diagram of the automatic liftable chair 3. Note here that, as shown in FIG. 1, the sitting position, the first seat position, and the second seat position are in such a positional relationship with one another that the "seat angle in the sitting position" is smaller than the "seat angle in the first seat position" and that the "seat angle in the first seat position" is smaller than the "seat angle in the second seat position". That is, a greater seat angle moves the user closer to a standing posture. In FIG. 3, the seat angle θ is an angle formed by a horizontal direction and a front-back direction of the seat; therefore, the seat angle θ takes on a value of 0 in a case where the seat is horizontal. On the other hand, in a case where the seat tilts toward the back of the automatic liftable chair 3, the seat angle θ takes on a negative value. Alternatively, the seat angle θ may be an angle formed by a vertical direction and the front-back direction of the seat.

(Configuration of Autonomous Mobile Robot)

As shown in FIG. 2, the autonomous mobile robot 2 includes: a main body 21; a moving apparatus 22 that causes the main body 21 to move in a self-supporting state; a handle 23, provided on the main body 21, which the user is able to grip; and an instruction inputter 24 that receives a stand-up assist instruction. It should be noted that the autonomous mobile robot 2 is hereinafter sometimes referred to simply as "robot 2".

The main body 21 is constituted by a frame having such rigidity as to be able to support the other constituent elements and bear the load with which the user stands up.

The moving apparatus 22 includes a plurality of wheels 25 provided at the bottom of the main body 21 and a driver 26 that moves the main body 21 by driving the wheels 25 to rotate. The wheels 25 support the main body 21 in a self-supporting state and are driven by the driver 26 to rotate, thereby moving the main body 21 while keeping it in the self-supporting posture. It should be noted that although the example here is a case where the moving apparatus 22 includes a moving mechanism in which wheels are used, there may alternatively be a case where a moving mechanism other than wheels (such as a traveling belt, a roller, or a multilegged mechanism) is used.

The handle 23 is provided on top of the main body 21. The handle 23 is provided in such a shape and height position that the user easily grips the handle 23 with both hands in a sitting state and a standing state.

Further, the robot 2 is provided with a first load detector 27 that detects a load applied to the handle 23. The first load detector 27 detects a load (i.e. a force in a vertical direction) generated in the handle 23 by the user gripping the handle 23. A usable example of such a first load detector 27 is a force sensor. Further, the handle load detected by the first load detector 27 is sent to the automatic liftable chair 3 through the network and used when the automatic liftable chair 3 performs a second assisting action to be described later.

The instruction inputter 24 has a function of receiving an indication of the user's intention to "stand up" as an assist instruction. The instruction inputter 24 may for example be a microphone, a button, a camera, or the like. In a case where the instruction inputter 24 is a microphone, the instruction inputter 24 may receive the assist instruction by acquiring the indication of the user's intention as a voice (e.g. a particular keyword) or a sound through the microphone and converting it into an electrical signal through a voice or sound recognizer. Alternatively, in a case where the instruction inputter 24 is a button, the user may input the indication of the user's intention by pressing the button. Alternatively, in a case where the instruction inputter 24 is a camera, the instruction in putter 24 may receive the assist instruction by acquiring an image of the user through the camera and recognizing a particular gesture or facial expression (e.g. closing one eye) through an image recognizer. The assist instruction needs only be information that notifies the robot 2 of the user's timing in standing up, and is not limited to those exemplified above.

Furthermore, the robot 2 is provided with a communicator 28 that sends information such as the handle load to the automatic liftable chair 3 through the network. The "network" here is a concept that not only refers to public line networks such as the so-called Internet but also encompasses short-distance communication technologies (such as Wi-Fi (registered trademark), Bluetooth (registered trademark), and infrared communication).

(Configuration of Automatic Liftable Chair)

As shown in FIG. 3, the automatic liftable chair 3 includes a seat 31 on which the user sits, a frame 32 that elevatably supports the seat 31, and a seat-moving apparatus 33 that moves the seat 31 so that the seat 31 tilts forward. Further, the automatic liftable chair 3 include an assistance control apparatus 34 that controls the movement of the seat 31 by the seat-moving apparatus 33 according to an instruction input or the like. The term "forward" as used herein means the direction that the front of the user is facing when the user is sitting on the automatic liftable chair 3, and the term "backward" as used herein means the direction that the back of the user is facing when the user is sitting on the automatic liftable chair 3. Further, the term "right-left direction" as used herein means the right-left direction based on the direction that the front of the user is facing. For example, in FIG. 1, the right-left direction is a direction perpendicular to the paper plane. It should be noted that the automatic liftable chair 3 is hereinafter sometimes referred to simply as "chair 3".

The seat 31 is supported by the frame 32. Specifically, a forward end of the seat 31 is supported by the frame 32 so that the seat 31 can rotate on a rotation axis parallel to the right-left direction. A backward end of the seat 31 is supported by the frame 32, for example, via a hydraulic elevating actuator 35 as a mechanism that mechanically extends and contracts in an up-down direction. Hydraulic extension and contraction of the elevating actuator 35 allows the seat 31 to move to change its angle θ. In Embodiment 1, the seat-moving apparatus 33 includes the elevating actuator 35 and, by causing the elevating actuator 35 to extend and contract, can move the seat 31 so that the seat 31 tilts forward. The angle θ of the seat 31 is herein expressed as an angular displacement based on the posture in which the seat 31 is when the user is in a sitting posture. It should be noted that the seat 31 may be moved by using any of the other various driving devices, such as an electric motor, instead of using the hydraulic elevating actuator 35.

Further, the seat 31 is provided with a seat angle detector 37 that detects the angle θ of the seat 31. As the seat angle detector 37, a tilt sensor or the like may be used. The angle θ of the seat 31 as detected by the seat angle detector 37 is inputted to the assistance control apparatus 34.

The assistance control apparatus 34 controls the movement of the seat 31 by the seat-moving apparatus 33 (i.e. the elevating actuator 35) on the basis of information regarding an assist instruction inputted to a communicator 38 of the automatic liftable chair 3 via the communication network from the communicator 28 of the autonomous mobile robot 2.

(Configuration of Life Assistance System)

Figure 4:
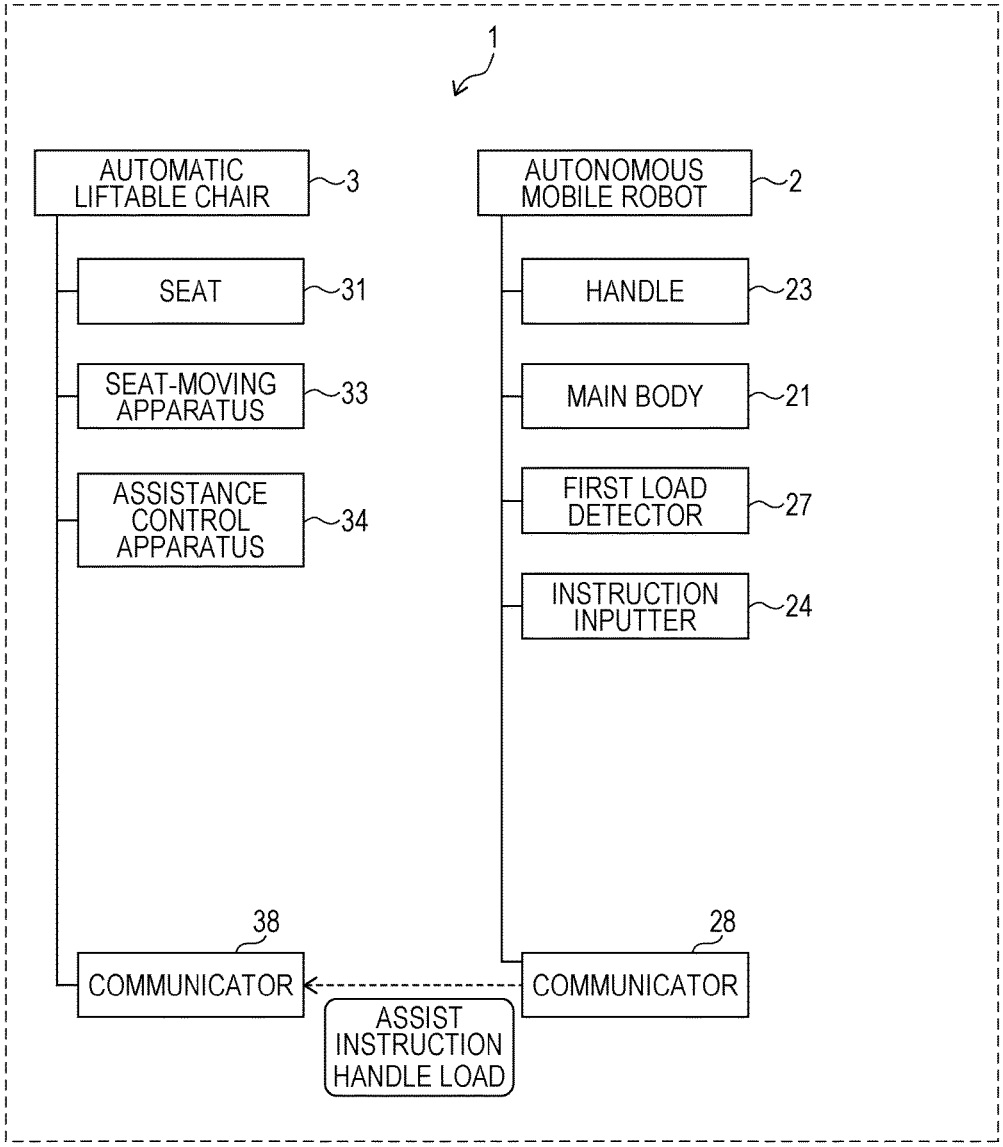
FIG. 4 is a control block diagram of the life assistance system of Embodiment 1.

Next, control components of the life assistance system 1 thus configured for controlling an assisting action of assisting the user in standing up is described. FIG. 4 is a control block diagram showing the main control components of the life assistance system 1. Further, the control block diagram of FIG. 4 also shows a relationship between each of the control components and information that is handled.

As shown in FIG. 4, in response to the inputting of a stand-up assist instruction (i.e. the inputting of an assist instruction), if any, the instruction inputter 24 of the robot 2 receives the assist instruction and notifies the chair 3 through the communicator 28 of reception information indicating that the assist instruction has been received. The assistance control apparatus 34 of the chair 3, which has received the notification, controls the seat-moving apparatus 33 so that the seat angle θ of the chair 3 changes from the sitting state to the first seat position. Further, upon detecting a load attributed to the holding of the handle 23 by the user, the first load detector 27 of the robot 2 notifies the chair 3 of load information (handle load) via the communicator 28. The assistance control apparatus 34 of the chair 3, which has received the notification through the communicator 38, controls the seat-moving apparatus 33 so that the seat angle θ of the chair 3 changes from the first seat position to the second seat position.

(Stand-Up Assist by Life Assistance System)

Next, the main steps of a procedure by which the life assistance system 1 of Embodiment 1 assists the user, who is sitting on the chair 3, in the act of standing up are described with reference to a flow chart shown in FIG. 5. Further, the flow chart of FIG. 5 shows exchange of information between the robot 2 and the chair 3, as well as the steps that are taken in the robot 2 and steps that are taken in the chair 3.

Figure 5:
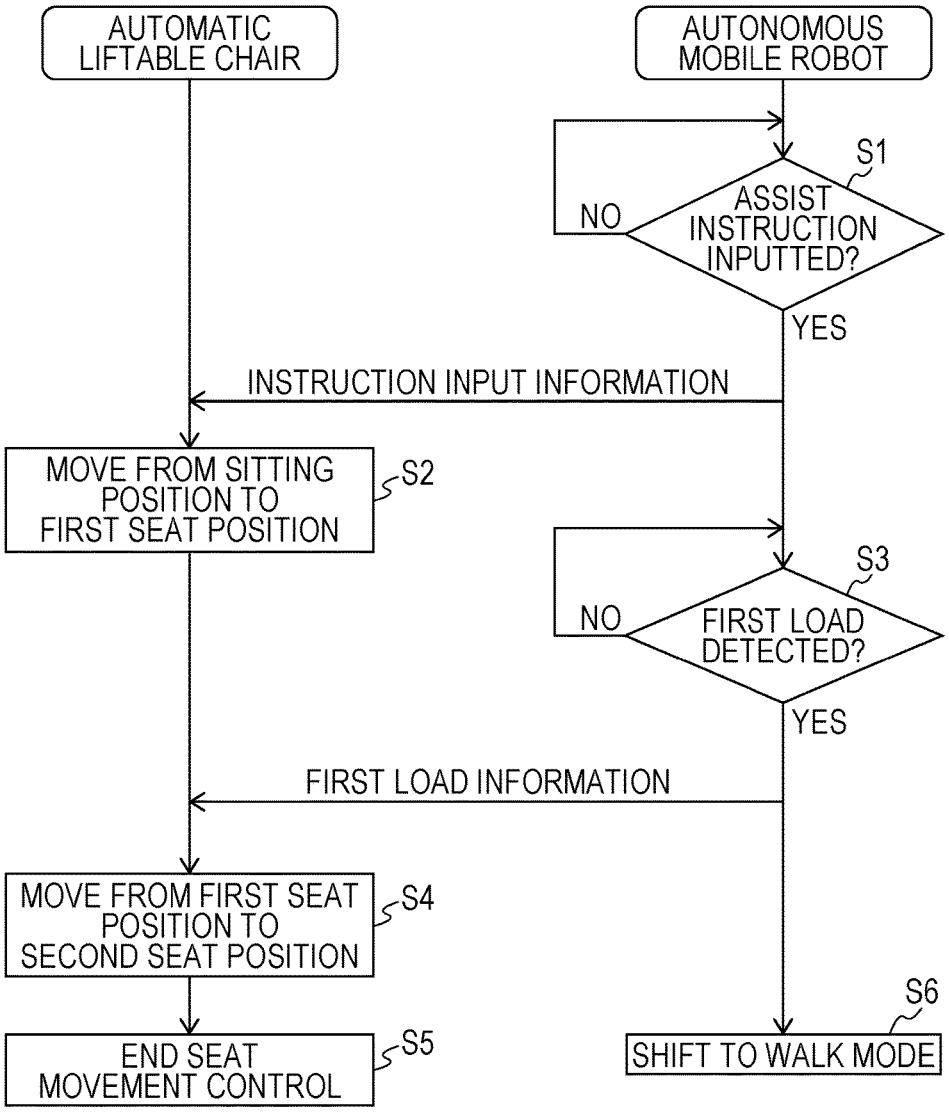
FIG. 5 is a flow chart showing a procedure for operation of the life assistance system of Embodiment 1.

First, in step S1 of FIG. 5, the instruction inputter 24 of the robot 2 waits for the inputting of an assist instruction that is an indication of the user's intension to stand up.

Upon receiving an input of an assist instruction, the instruction inputter 24 notifies the communicator 28 to that effect. The communicator 28 notifies the communicator 38 of the chair 3 through the network of reception information indicating that the assist instruction has been received. Upon receipt of the reception information from the communicator 38, the assistance control apparatus 34 in the chair 3 controls the seat 31 so that the seat 31 moves from the sitting positon (initial position) to the first seat position (step S2: first assisting action). Specifically, the assistance control apparatus 34 controls the movement of the seat 31 by controlling the seat-moving apparatus 33 (i.e. the hydraulic elevating actuator 35). At this point in time, the assistance control apparatus 34 may acquire the angle of the seat 31 from the tilt sensor 37 and exercise feedback control of movement of the seat 31 according to this angle.

Next, in step S3 of FIG. 5, the first load detector 27 of the robot 2 detects whether a load has been detected. Detecting a load here means detecting whether the user has touched the handle 23 of the robot 2. Upon detecting a load (handle load) applied to the handle 23 by the user, the first load detector 27 notifies the assistance control apparatus 34 of the chair 3 of first load information (load detection information) via the communicators 28 and 38 to that effect. Upon receiving this notification, the assistance control apparatus 34 controls the seat 31 so that the seat 31 moves from the first seat position to the second seat position (step S4: second assisting action).

Once the seat 31 reaches the second seat position, the control of movement of the seat 31 ends (step S5), whereby the stand-up assist process is ended. After that, with the handle 23 gripped by the user, who has stood up, the robot 2 switches from a stand-up assist mode to a walk assist mode (step S6), and may start to assist the user in the act of walking.

As described above, the life assistance system 1 of Embodiment 1 makes a first-stage seat movement at a timing when the user indicates his/her intention to stand up from the chair 3, thereby inducing the user to be mentally and physically prepared to stand up. After that, with the user able to actually stand up by gripping the handle 23 of the robot 2, the life assistance system 1 can make a second-stage seat movement for the user to actually stand up from the chair 3.

Embodiment 2

Next, a life assistance system 71 according to Embodiment 2 of the present disclosure is described with reference to a configuration diagram of an automatic liftable chair 73 of FIG. 6 and a control block diagram of FIG. 7. Components of the life assistance system 71 according to Embodiment 2 that are identical to those of the life assistance system 1 according to Embodiment 1 are given the same reference numerals and, as such, are not described below. The life assistance system 71 of Embodiment 2 is described below with a focus on the differences between the life assistance system 71 of Embodiment 2 and the life assistance system 1 of Embodiment 1.

Figure 6:
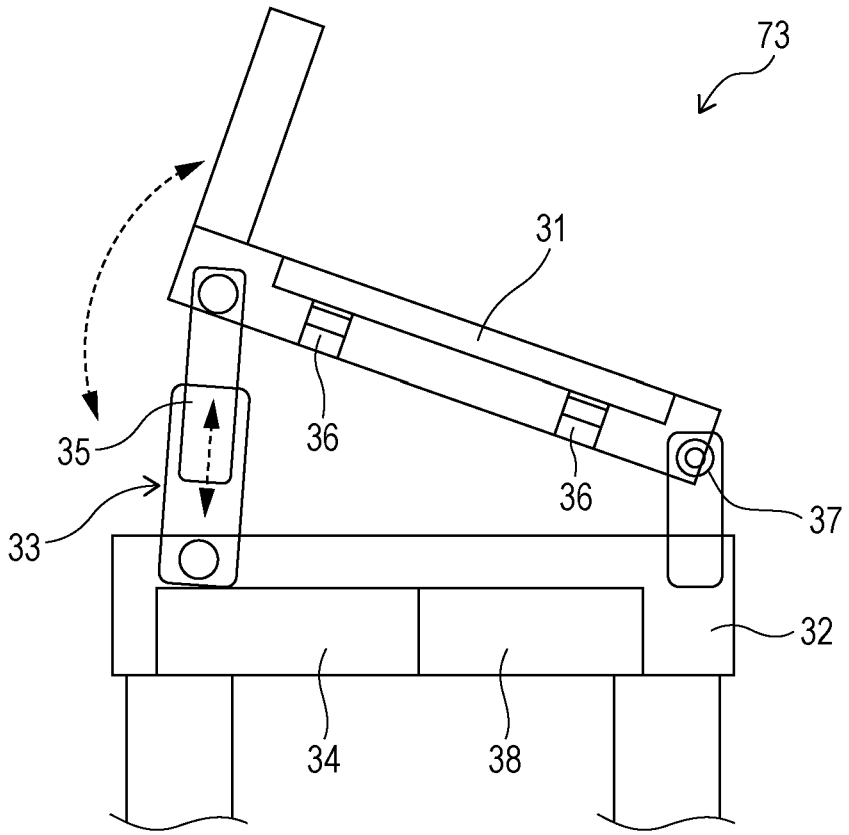
FIG. 6 is an appearance diagram of an automatic liftable chair of Embodiment 2 of the present disclosure.

FIG. 6 shows a configuration of the automatic liftable chair 73 of Embodiment 2. In FIG. 6, the automatic liftable chair 73 differs from the automatic liftable chair 3 in Embodiment 1 in that the automatic liftable chair 73 further includes a second load detector 36 in the lower part of the seat 31. The second load detector 36 detects how much of his/her weight the user puts on the chair 73 while he/she is sitting on the seat 31. Typically, the second load detector 36 is constituted by a pressure sensor. However, the second load detector 36 is not limited to this, provided it is configured to be able to detect a load.

Figure 7:
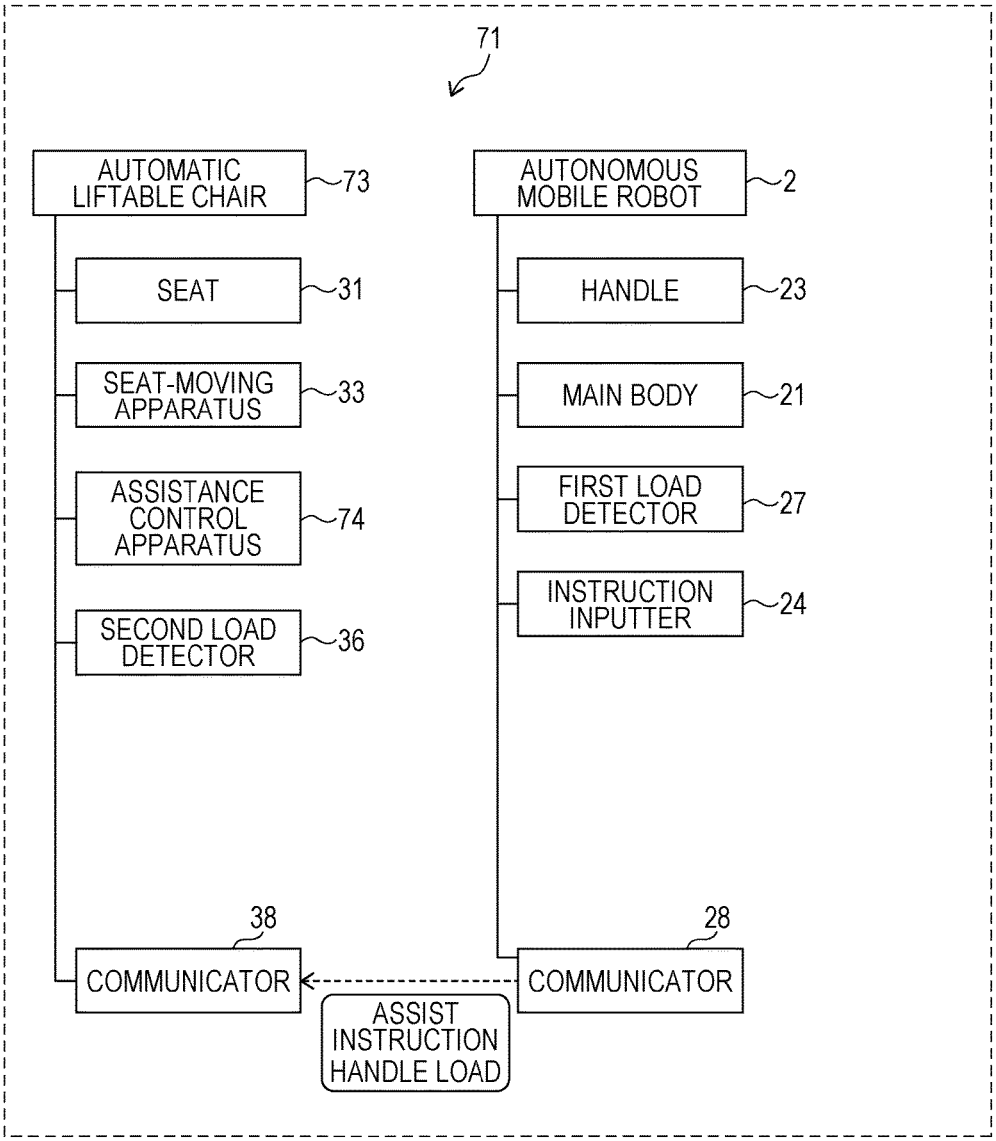
FIG. 7 is a control block diagram of a life assistance system of Embodiment 2.

FIG. 7 shows a control block diagram of the life assistance system 71 according to Embodiment 2. Embodiment 2 differs from Embodiment 1 in that the automatic liftable chair 73 includes the second load detector 36 and that an assistance control apparatus 74 controls the seat-moving apparatus 33 on the basis of information from the first load detector 27 and information from the second load detector 36. Specifically, the assistance control apparatus 74 performs the following control:

The assistance control apparatus 74 detects second load data from the second load detector 36 in a case where the first load detector 27 receives, from the autonomous mobile robot 2, notification that a load has been detected (notification of load detection information). Then, at a timing of detection of a decrease in the second load data, the assistance control apparatus 74 commands the seat-moving apparatus 33 to move the seat 31 from the first seat position to the second seat position. It should be noted that a decrease in the second load data may be determined in a case where the second load data becomes equal to or lower than a preset threshold.

As described above, the life assistance system 71 according to Embodiment 2 of the present disclosure makes it possible to lift the automatic liftable chair 73 along with the user's own act of standing up from the chair 73, thus making it possible to achieve a smoother stand-up action.

Embodiment 3

Next, a life assistance system 91 according to Embodiment 3 of the present disclosure is described with reference to a configuration diagram of an autonomous mobile robot 92 in FIG. 8, a control block diagram in FIG. 9, a more detailed control block diagram of a route-of-movement setter 94 in FIG. 10, and a flow chart of operation of the autonomous mobile robot 92 in FIG. 11. Components of the life assistance system 91 according to Embodiment 3 that are identical to those of the life assistance system 1 according to Embodiment 1 are given the same reference numerals and, as such, are not described below. The life assistance system 91 of Embodiment 3 is described below with a focus on the differences between the life assistance system 91 of Embodiment 3 and the life assistance system 1 of Embodiment 1.

Figure 8:
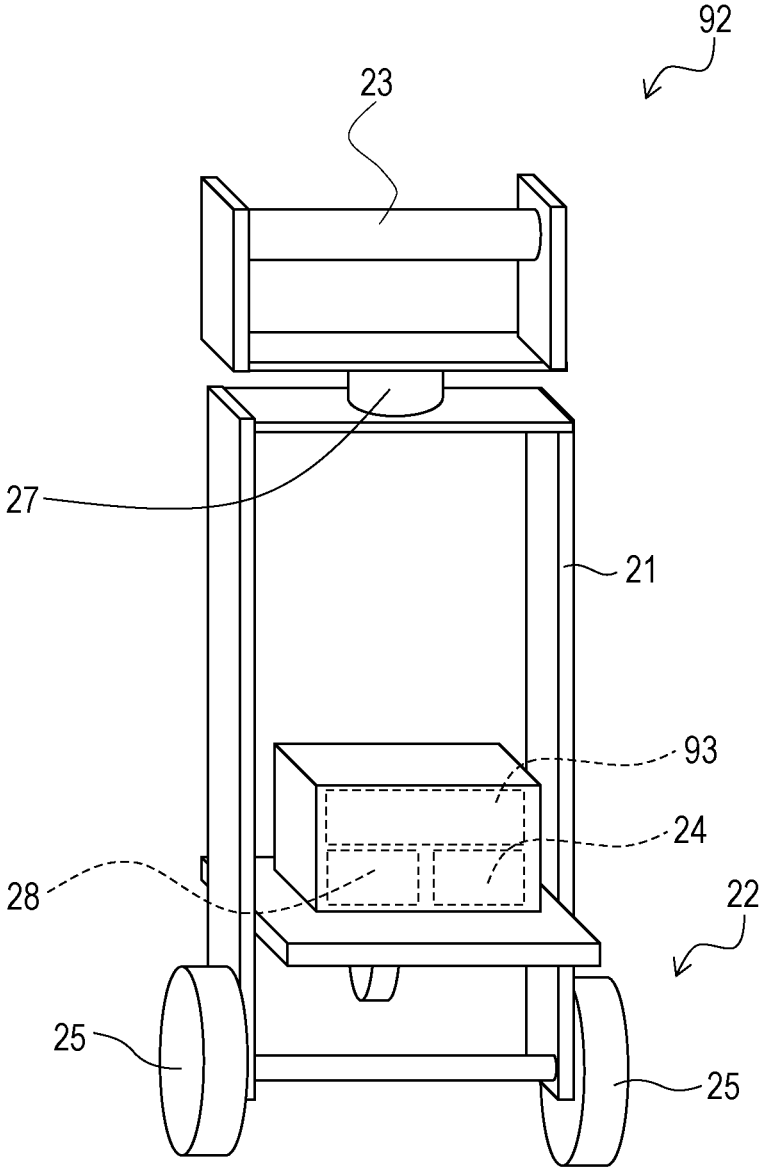
FIG. 8 is an appearance diagram of an autonomous mobile robot of Embodiment 3 of the present disclosure.

FIG. 8 is a configuration diagram of the autonomous mobile robot 92 in the life assistance system 91 according to Embodiment 3. In FIG. 8, the autonomous mobile robot 92 differs from the autonomous mobile robot 2 of Embodiment 1 in that the autonomous mobile robot 92 includes a movement controller 93. As will be described later, the movement controller 93 calculates a relative positional relationship between the autonomous mobile robot 92 and the automatic liftable chair 3. On the basis of the positional relationship thus calculated, the autonomous mobile robot 92 determines a route of movement to an assisting place defined in an area near a place that is in front of the automatic liftable chair 3, and on the basis of the route of movement, the autonomous mobile robot 92 moves to the assisting place.

Figure 9:
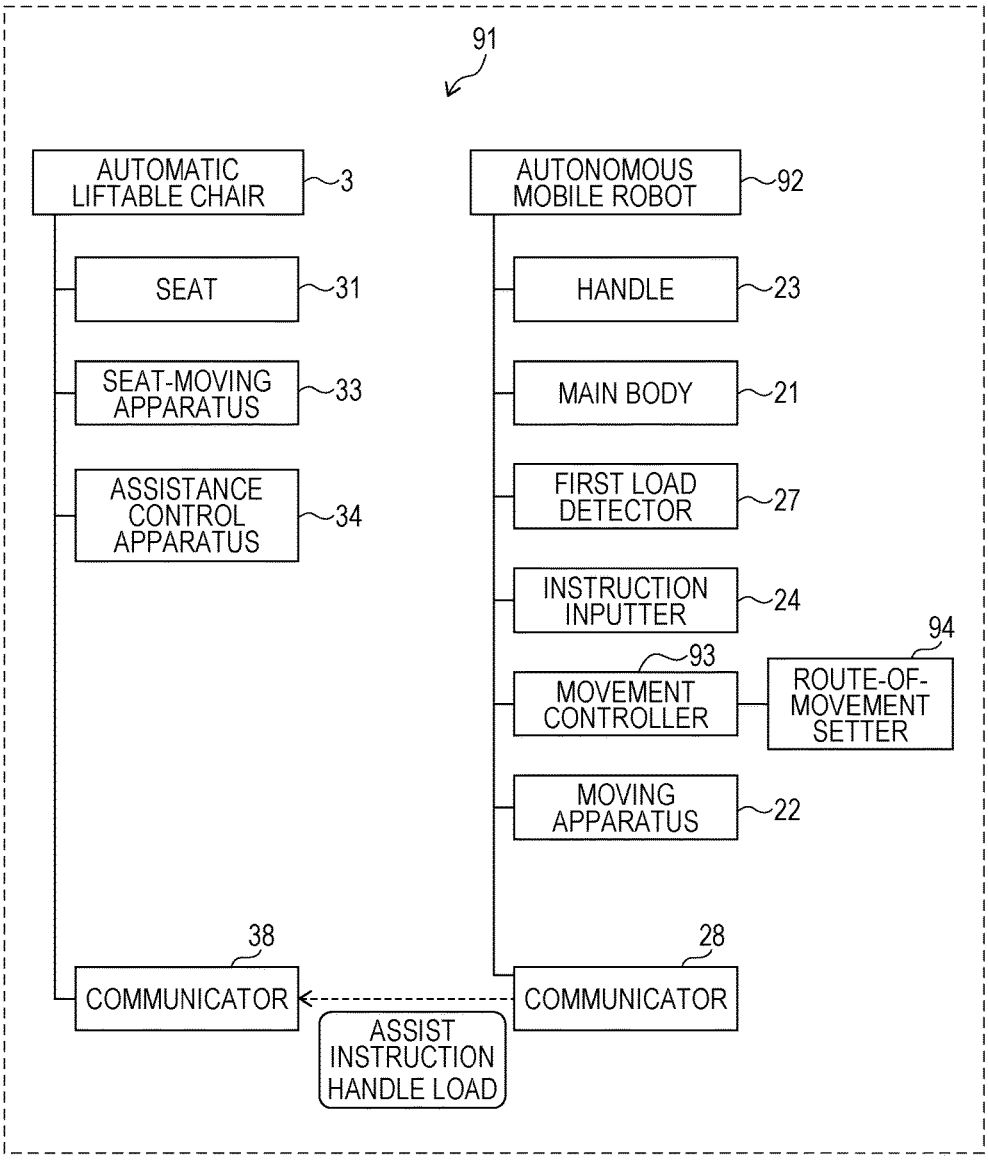
FIG. 9 is a control block diagram of a life assistance system of Embodiment 3.

FIG. 9 is a control block diagram of the life assistance system 91 according to Embodiment 3. In FIG. 9, the life assistance system 91 differs from the life assistance system 1 in Embodiment 1 in that the life assistance system 91 further includes the movement controller 93 including the route-of-movement setter 94 and that the moving apparatus 22 carries out control of movement of the autonomous mobile robot 92 on the basis of control of movement by the movement controller 93. It should be noted that although Embodiment 3 is configured such that the route-of-movement setter 94 is built in the movement controller 93, Embodiment 3 is not limited to such a configuration. For example, the route-of-movement setter 94 may be installed outside the autonomous mobile robot 92 and exchange control information by communicating with the autonomous mobile robot 92.

Figure 10:
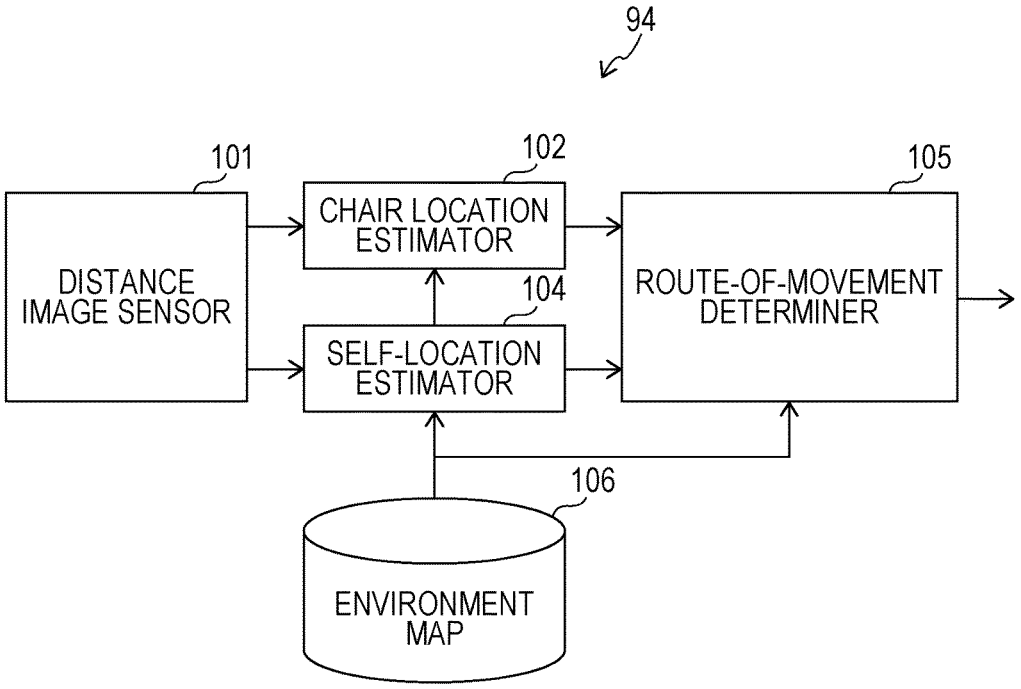
FIG. 10 is a detailed control block diagram of a route-of-movement setter of Embodiment 3.
Figure 11:
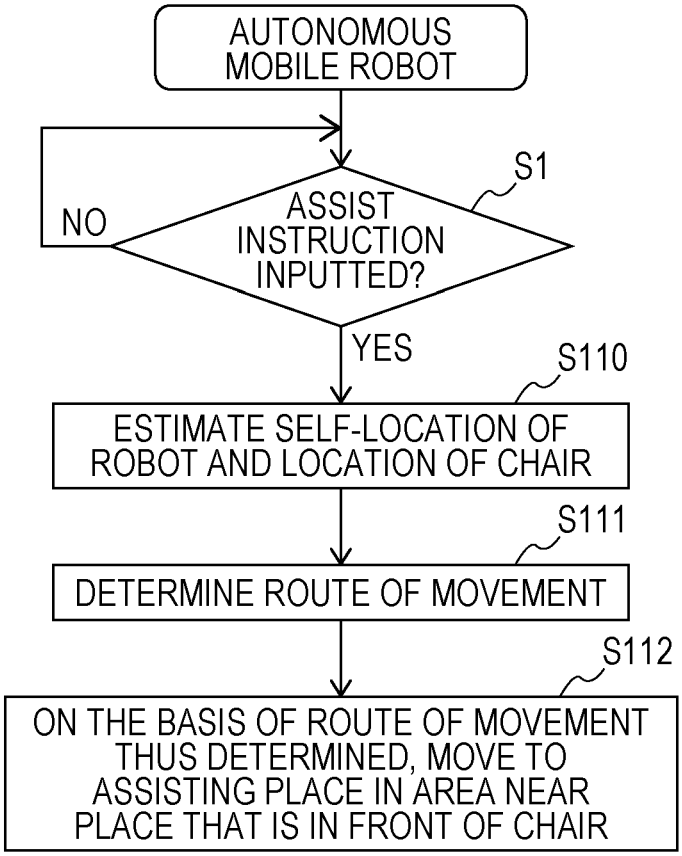
FIG. 11 is a flow chart showing a procedure for operation of the autonomous mobile robot of Embodiment 3.

FIG. 10 is a control block diagram explaining a configuration of the route-of-movement setter 94 in more detail. As shown in FIG. 10, the route-of-movement setter 94 includes a distance image sensor 101, a chair location estimator 102, a self-location estimator 104, and a route-of-movement determiner 105. In FIG. 10, the distance image sensor 101 captures an image of the outside world with an image sensor, for example. As one example, the distance image sensor 101 may take an image of an environment in which the life assistance system 91 is placed, for example with a camera from above. Then, the chair location estimator 102 analyzes the image captured by the distance image sensor 101 and estimates the location of the automatic liftable chair 3 on the basis of an environment map 106 storing a map of the environment in which the life assistance system 91 is placed. More specifically, the chair location estimator 102 estimates a highly likely location by performing matching between an image taken from above and a "shape image of the chair 3 as viewed from above" acquired in advance and comparting a result of the image matching with the environment map 106. Similarly, the self-location estimator 104, too, estimates a highly likely self-location (i.e. the location of the robot 92) by comparing the result of the image matching to the environment map 106. It should be noted that the self-location of the chair 3 may be estimated by any of various methods other than that described above. For example, the self-location of the chair 3 may alternatively be estimated by estimating a distance and direction of movement by accumulating rotation angles of the wheels 25. In Embodiment 3, the method of location estimation is not limited to that described above, as it is only necessary to estimate the locations of the automatic liftable chair 3 and the autonomous mobile robot 92. After that, the route-of-movement determiner 105 calculates the relative locations of the automatic liftable chair 3 and the autonomous mobile robot 92 on the basis of the location estimation results yielded by the chair location estimator 102 and the self-location estimator 104. On the basis of the relative positional relationship thus calculated, the route-of-movement determiner 105 determines a route of movement from the current location of the robot 92 to an "assisting place" defined in an area near a place that is in front of the automatic liftable chair 3.

In the presence of an input of a stand-up assist instruction (step S1), the autonomous mobile robot 92 in Embodiment 3 estimates the self-location of the autonomous mobile robot 92 and the location of the automatic liftable chair 3 according to the method described above (step S110). After that, the autonomous mobile robot 92 determines a route of movement of the autonomous mobile robot 92 (step S111), and on the basis of the route of movement thus determined, the autonomous mobile robot 92 moves to the assisting place in the area near the place that is in front of the automatic liftable chair 3 (step S112).

As described above, the life assistance system 91 according to Embodiment 3 of the present disclosure allows the autonomous mobile robot 92 to, in providing stand-up assistance, to move to the assisting place that is in front of the automatic liftable chair 3. This brings about effects of making it possible to go to the robot 92 for help as needed and avoiding disturbance during reclining.

Embodiment 4

Figure 12:
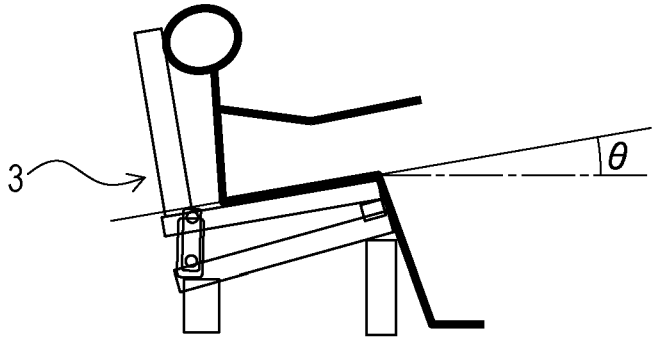
FIG. 12 is a schematic view of an automatic liftable chair of Embodiment 4 of the present disclosure.

Next, a life assistance system 1 according to Embodiment 4 of the present disclosure is described with reference to a configuration diagram of FIG. 12. In Embodiment 4, the front-back direction of the seat 31 of the automatic liftable chair 3 in the sitting position tilts toward the back of the automatic liftable chair 3 with respect to the horizontal direction (horizontal plane). That is, in FIG. 12, the seat angle θ, which is an angle formed by the front-back direction of the seat 31 and the horizontal plane, has a tilt toward a higher position than the horizontal plane (that is, the seat angle θ takes on a negative value).

As described above, the automatic liftable chair 3 in Embodiment 4 allows the user to, in the sitting position, adopt a reclining posture at a greater angle, thus making it possible to provide the user with more comfort. This also makes it possible to assist the user in standing up from the sitting position in such a reclining state at a great angle.

Embodiment 5

Figure 13:
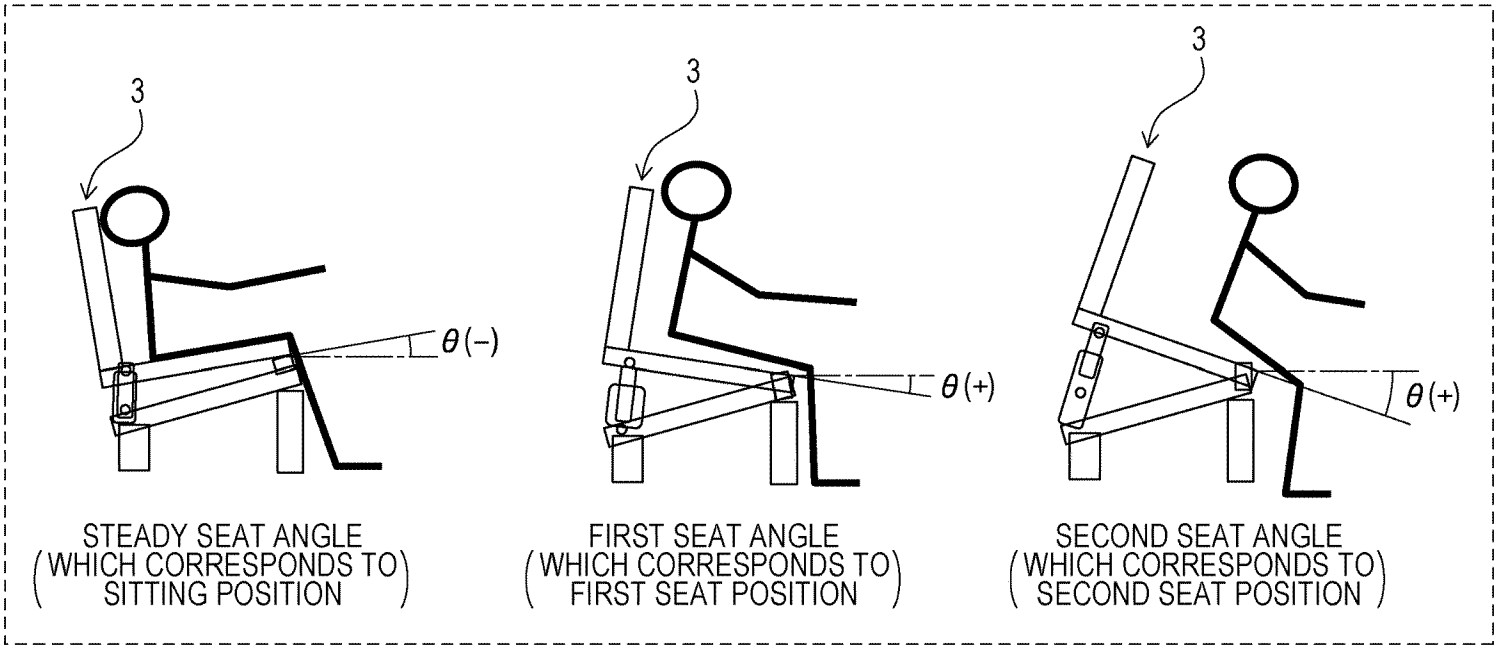
FIG. 13 is a schematic view of an automatic liftable chair of Embodiment 5 of the present disclosure.

Next, an automatic liftable chair 3 in a life assistance system 1 according to Embodiment 5 of the present disclosure is described with reference to a schematic view of FIG. 13. In Embodiment 5, a method for defining the seat angle θ is described. In FIG. 13, the seat angle θ is defined such that a positive sense of the angle formed by the front-back direction of the seat 31 and the horizontal direction is a clockwise direction from the horizontal direction toward the front-back direction of the seat 31. As shown in FIG. 13, in the sitting position described in Embodiment 4 (i.e. the sitting position in a reclining state at a great angle), the seat angle θ (steady seat angle) takes on a negative value. Meanwhile, in each of the first and second seat positions, the seat angle θ takes on a positive value. It should be noted that the first seat angle is an angle that lies between the steady seat angle and the second seat angle.

Embodiment 6

Figure 14:
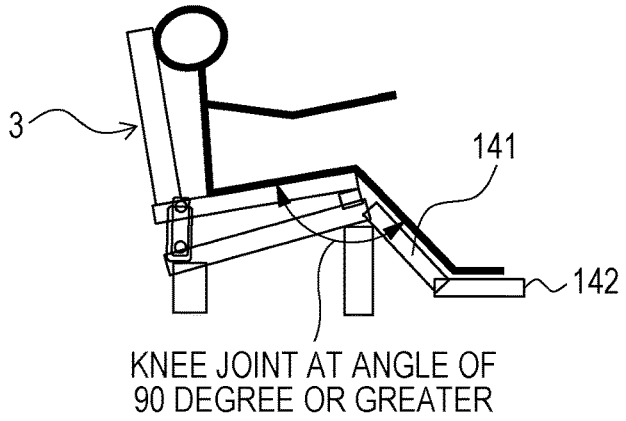
FIG. 14 is a schematic view of an automatic liftable chair of Embodiment 6 of the present disclosure.

Next, an automatic liftable chair 3 according to Embodiment 6 of the present disclosure is described with reference to a schematic view of FIG. 14. The automatic liftable chair 3 in Embodiment 6 includes at least either a footrest 142 or a leg rest 141. Further, the automatic liftable chair 3 is configured such that when the user is using at least either the footrest 142 or the leg rest 141, the user has his/her knee joint at an angle of greater than 90 degrees. Conversely, the footrest 142 or the leg rest 141 is set so that the angle of the knee joint of the user becomes greater than 90 degrees.

As described above, the automatic liftable chair 3 according to Embodiment 6 allows the user to, in the sitting position, adopt a posture in which he/she stretches his/her legs forward, thus making it possible to provide the user with more comfort.

Embodiment 7

Next, an automatic liftable chair 151 according to Embodiment 7 of the present disclosure is described with reference to a schematic view of FIG. 15. The automatic liftable chair 151 according to Embodiment 7 differs from the automatic liftable chair 3 according to Embodiment 1 in that the automatic liftable chair 151 includes a displacement mechanism 153 and a seat 152 provided on top of the displacement mechanism 153.

Figure 15:
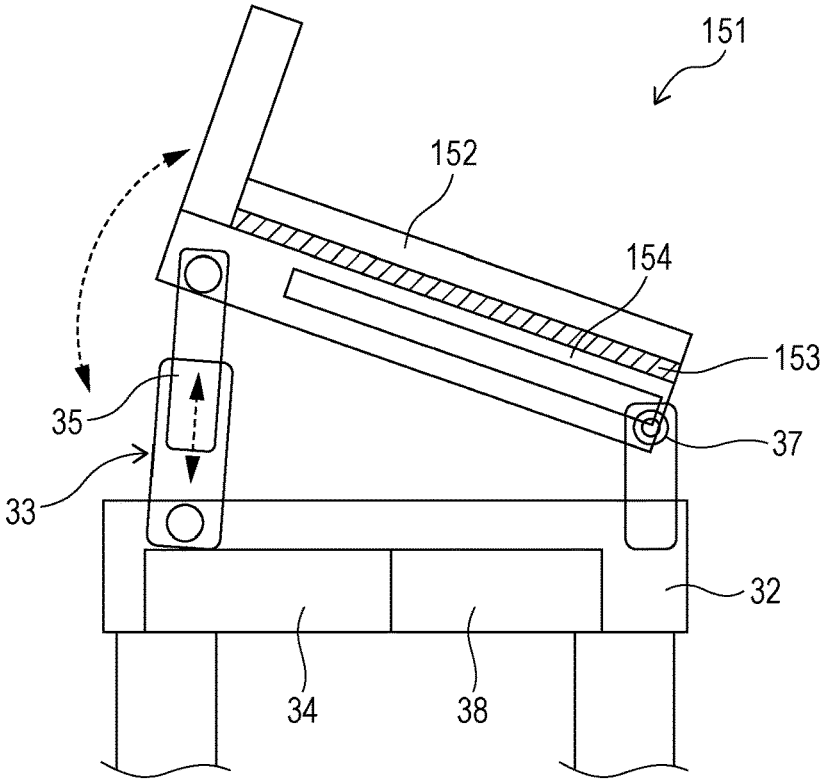
FIG. 15 is a schematic view of an automatic liftable chair of Embodiment 7 of the present disclosure.

As shown in FIG. 15, the chair 151 includes the displacement mechanism 153 provided on top of a seat base (which corresponds to the seat 31 of the chair 3 of Embodiment 1) 154 and the seat 152 provided on top of the displacement mechanism 153. The displacement mechanism 153 has a function of sliding the seat 152 in a front-back direction with respect to the seat base 154. The displacement mechanism 153 may be constituted, for example, by rails and a slider that slides along the rails. For example, the seat 152 may be slid in a front-back direction with respect to the seat base 154 by fixing the rails to one of the seat base 154 and the seat 152, fixing the slider to the other of the seat base 154 and the seat 152, and moving the slider along the rails.

When a user sitting on the chair 151 thus configured gives a stand-up assist instruction to the robot 2, the seat 152 of the chair 151 is moved from the sitting position to the first seat position (first assisting action). Since the first seat position is a seat angle that tilts forward, the user's own weight causes the seat 152 to slide forward with respect to the seat base 154 through the displacement mechanism 153. That is, the first assisting action displaces the seat 152 of the chair 151 from the sitting position to the first seat position that is closer to the front of the chair 151 than the sitting position. This allows the user to move closer to the robot 2 and easily grip the handle 23. After that, upon detection of a load on the handle 23, a second assisting action is started.

By performing the first assisting action, the chair 151 of Embodiment 7 allows the user to adopt a posture closer to the robot 2 and easily grip the handle 23. For example, in a case where the chair 151 assumes a sitting position in a reclining state at a greater angle (the seat angle θ takes on a negative value), the user is in a state of sitting deeply back on the chair 151. Even in such a case, displacing the seat 152 forward through the first assisting action allows the user to easily grip the handle 23, thus providing the user with more convenience. It should be noted that the chair 151 may include a footrest and a leg rest, although FIG. 15 omits to illustrate them.

Embodiment 8

Next, a life assistance system 161 according to Embodiment 8 of the present disclosure is described with reference to a control block diagram of the life assistance system 161 in FIG. 16 and a flow chart of operation in FIG. 17. Components of the life assistance system 161 according to Embodiment 8 that are identical to those of the life assistance system 1 according to Embodiment 1 are given the same reference numerals and, as such, are not described below. The life assistance system 161 of Embodiment 8 is described below with a focus on the differences between the life assistance system 161 of Embodiment 8 and the life assistance system 1 of Embodiment 1.

Figure 16:
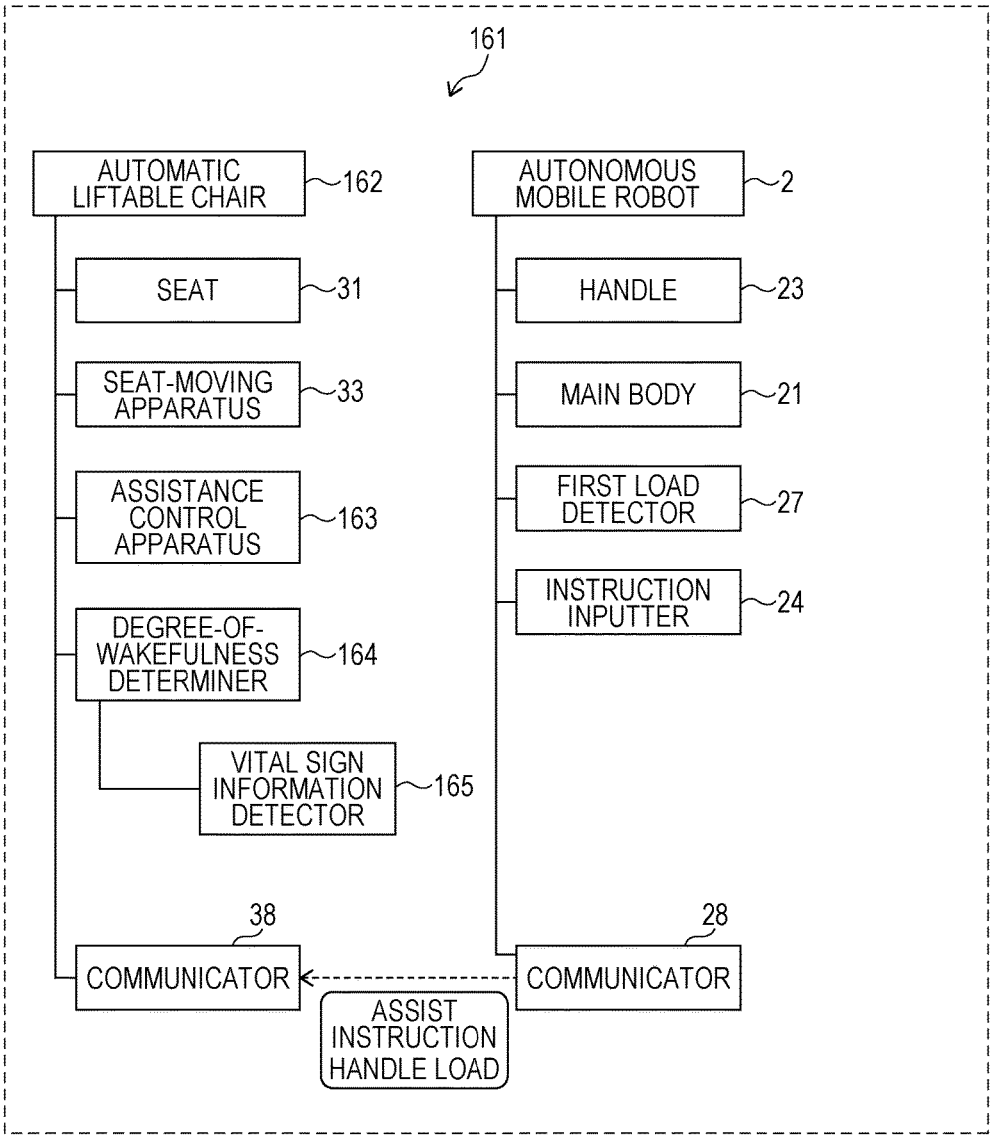
FIG. 16 is a control block diagram of a life assistance system of Embodiment 8 of the present disclosure.

FIG. 16 is a control block diagram of the life assistance system 161 according to Embodiment 8. Embodiment 8 differs from Embodiment 1 in that an automatic liftable chair 162 includes a vital sign information detector 165 and a degree-of-wakefulness determiner 164 and that an assistance control apparatus 163 controls the speed of movement of the seat 31 on the basis of information from the vital sign information detector 165 and the degree-of-wakefulness determiner 164.

The vital sign information detector 165 detects an immediate load change (body motion), pulse rate, heartbeat, respiration rate, or the like. Moreover, the degree-of-wakefulness determiner 164 determines the degree of wakefulness of the user from these pieces of vital sign information.

The vital sign information detector 165 may for example be a load sensor provided in the seat 31 or backrest (back surface) of the chair 162. The load change (body motion), the pulse rate, the heartbeat, the respiration rate, or the like may be detected by this load sensor catching a change in pressure of the user's body surface (biological surface). For example, since the shape of the user's body changes due to respiration, this change may be detected as a load. Alternatively, the pulse rate may be detected as a change in vascular surface. Further, the heartbeat may be detected as a change in the body surface that is close to the user's heart. Plural pieces of vital sign information such as pulse rate, heartbeat, and respiration rate may be detected by one load sensor. It should be noted that, as for the pulse rate, a publicly-known pulse-taking method or apparatus such as an infrared pulse meter may be used. Further, as for the respiration rate, too, a method for catching a bulge in the user's body with a distance sensor, a method for detection in an image with a camera, or the like may be used.

The degree-of-wakefulness determiner 164 determines the degree of wakefulness of the user on the basis of the vital sign information detected by the vital sign information detector 165. For example, in the case of vital sign information indicating a frequent load change, a high pulse rate, or a high respiration rate, the degree-of-wakefulness determiner 164 can determine that the degree of wakefulness of the user is high.

Further, in a case where the vital sign information is data representing the pulse rate or the heartbeat, the degree-of-wakefulness determiner 164 may determine, upon detecting a decrease (e.g. 10% decrease) in pulse rate or heartbeat or an increase in HF component (high-frequency component), that the degree of wakefulness of the user is low (e.g. the user is sleeping). Further, upon detecting a state where the pulse rate or the heartbeat lowers (e.g. continuously and gradually lowers) or the HF component continuously rises, the degree-of-wakefulness determiner 164 can determine that the degree of wakefulness of the user is low (e.g. the user is about to fall asleep).

It is also conceivable to measure the user's brain waves as another method for detecting vital sign information and determining the degree of wakefulness on the basis of the vital sign information thus detected. Since it is known that the degree of wakefulness is low in a case where alpha-wave and theta-wave components are found in the brain waves, this measurement data can be used to determine whether the degree of wakefulness is high. Finally, the assistance control apparatus 163 exercises control to determine the speed of movement of the seat 31 on the basis of the degree of wakefulness of the user thus determined. Specifically, the lower the degree of wakefulness becomes, the slower the speed of movement of the seat 31 becomes.

Figure 17:
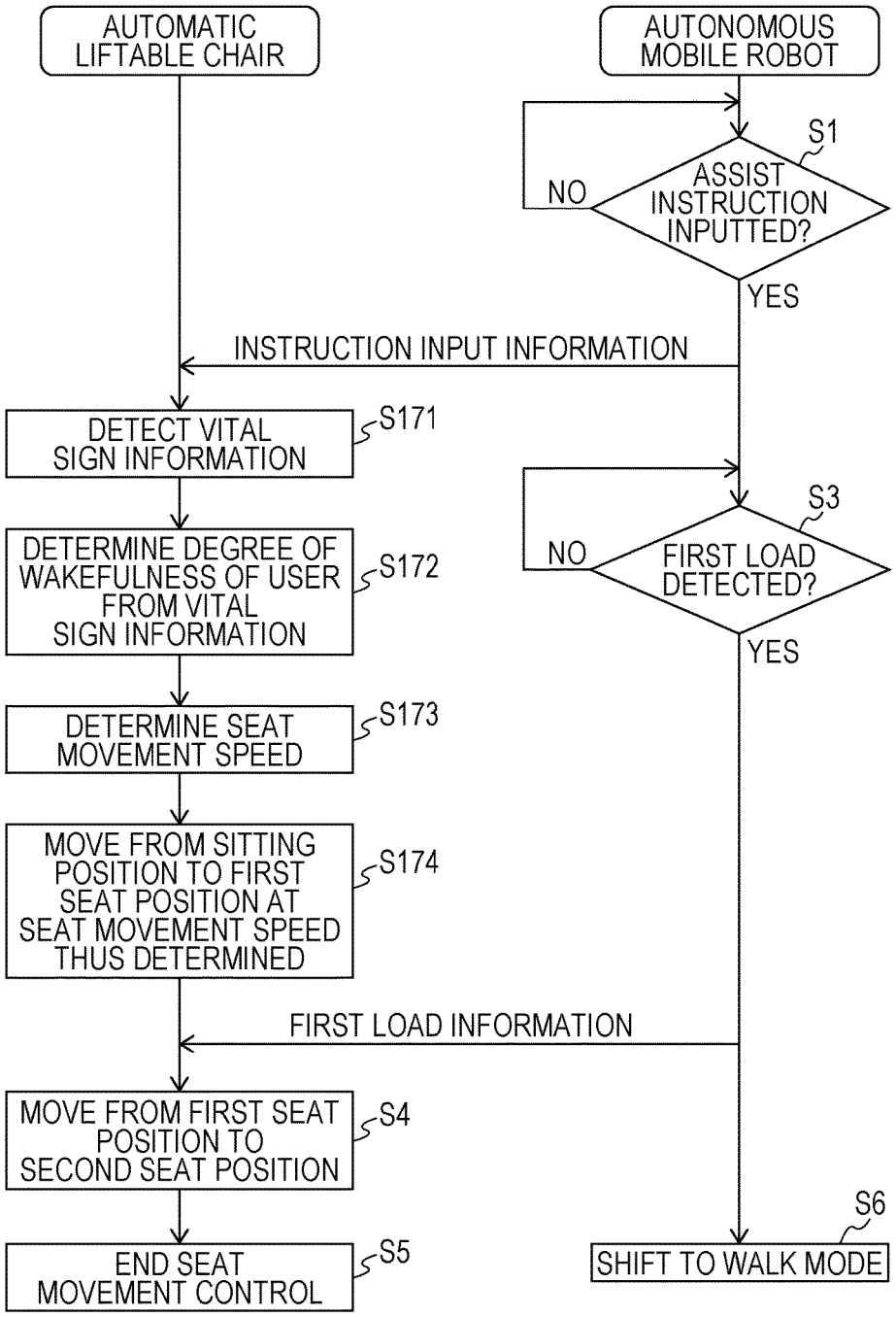
FIG. 17 is a flow chart showing an operation of the life assistance system of Embodiment 8.

FIG. 17 is a flow chart of operation of the life assistance system 161 according to Embodiment 8. First, the vital sign information detector 165 of the automatic liftable chair 162 detects the user's immediate load change (body motion), pulse rate, respiration rate, or the like (step S171). Next, the degree-of-wakefulness determiner 164 determines the degree of wakefulness of the user from the aforementioned vital sign information (step S172). It should be noted that the degree of wakefulness can be determined according to whether the degree of wakefulness is not less than or less than a threshold. The assistance control apparatus 163 determines the speed of movement of the seat 31 of the automatic liftable chair 162 so that the lower the aforementioned degree of wakefulness becomes, the slower the speed of movement of the seat 31 becomes (step S173). The seat-moving apparatus 33 moves the seat 31 from the sitting positon to the first seat position at the speed of movement thus determined (step S174).

As described above, the life assistance system 161 according to Embodiment 8 of the present disclosure allows the automatic liftable chair 162 to, in providing stand-up assistance, move the seat 31 at a speed corresponding to the degree of wakefulness of the user. This for example prevents the user from being taken by surprise at a rapid speed when he/she has a low degree of wakefulness, thus making it possible to more safely execute the stand-up action.

Embodiment 9

Next, a life assistance system 181 according to Embodiment 9 of the present disclosure is described with reference to a control block diagram of the life assistance system 181 in FIG. 18 and a flow chart of operation in FIG. 19. Components of the life assistance system 181 according to Embodiment 9 that are identical to those of the life assistance system 1 according to Embodiment 1 are given the same reference numerals and, as such, are not described below. The life assistance system 181 of Embodiment 9 is described below with a focus on the differences between the life assistance system 181 of Embodiment 9 and the life assistance system 1 of Embodiment 1.

Figure 18:
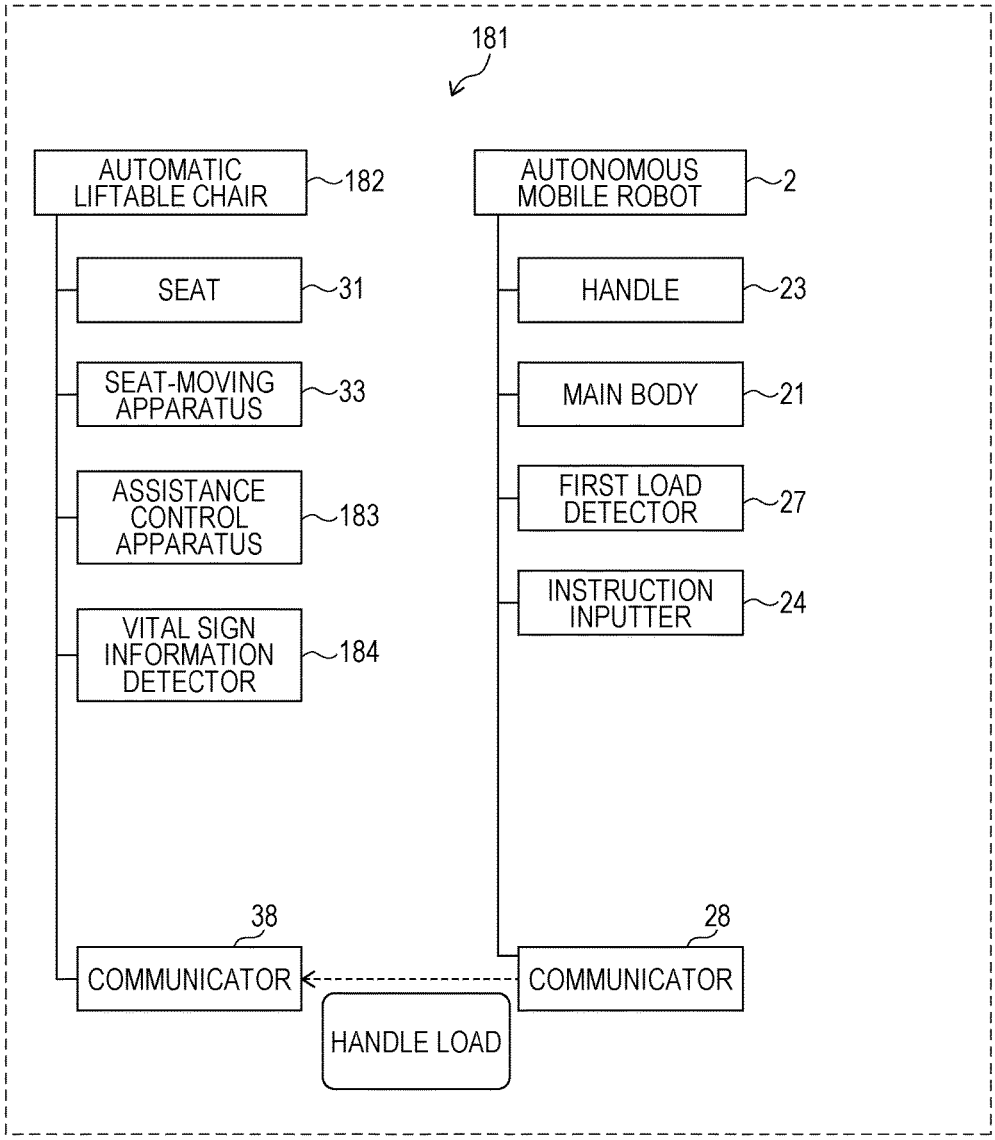
FIG. 18 is a control block diagram of a life assistance system of Embodiment 9 of the present disclosure.

FIG. 18 is a control block diagram of the life assistance system 181 according to Embodiment 9. Embodiment 9 differs from Embodiment 1 in that a vital sign information detector 184 mainly detects the user's load change (body motion) and that in a case where an amount of change of the aforementioned load change (which corresponds to the intensity of the body motion) is not less than a predetermined value, an assistance control apparatus 183 starts an assisting action of an automatic liftable chair 182 without waiting for an assist instruction from the autonomous mobile robot 2.

Figure 19:
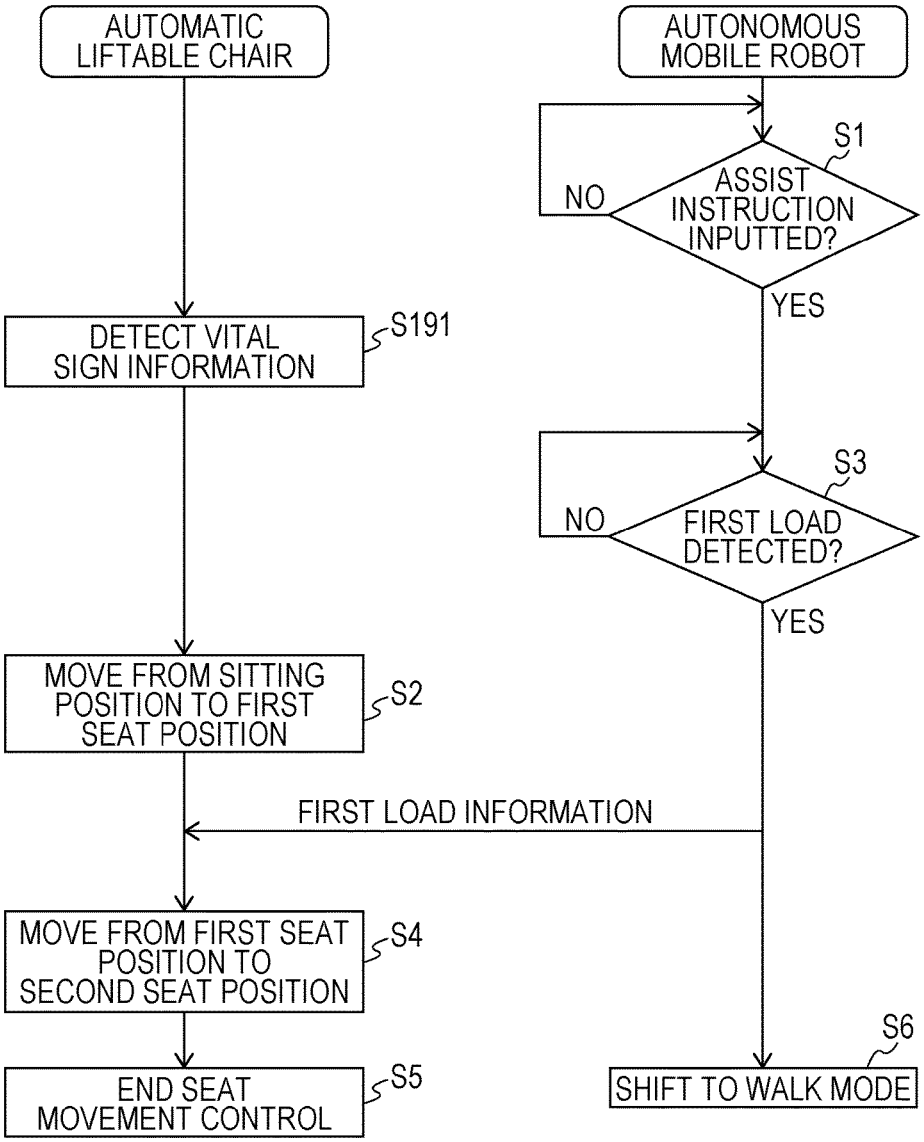
FIG. 19 is a flow chart showing an operation of the life assistance system of Embodiment 9.

FIG. 19 is a flow chart of operation of the life assistance system 181 according to Embodiment 9. First, in the automatic liftable chair 182, the vital sign information detector 184 mainly detects the user's load change (step S191). Information representing the user's load change thus detected is inputted to the assistance control apparatus 183. In a case where the aforementioned amount of load change is not less than the predetermined value, the assistance control apparatus 183 moves the seat 31 from the sitting position to the first seat position without waiting for an assist instruction from the autonomous mobile robot 2 that is inputted via the communicator 38 (step S2).

As described above, when the amount of the user's load change is large (that is, the user is prepared to stand up from the automatic liftable chair 182), the first assisting action is executed regardless of the presence or absence of reception information. This makes it possible to start the stand-up action at a timing appropriate for the user.

Embodiment 10

Next, a life assistance system 201 according to Embodiment 10 of the present disclosure is described with reference to a control block diagram of the life assistance system 201 in FIG. 20 and a flow chart of operation in FIG. 21. Components of the life assistance system 201 according to Embodiment 10 that are identical to those of the life assistance system 161 according to Embodiment 8 are given the same reference numerals and, as such, are not described below. The life assistance system 201 of Embodiment 10 is described below with a focus on the differences between the life assistance system 201 of Embodiment 10 and the life assistance system 161 of Embodiment 8.

Figure 20:
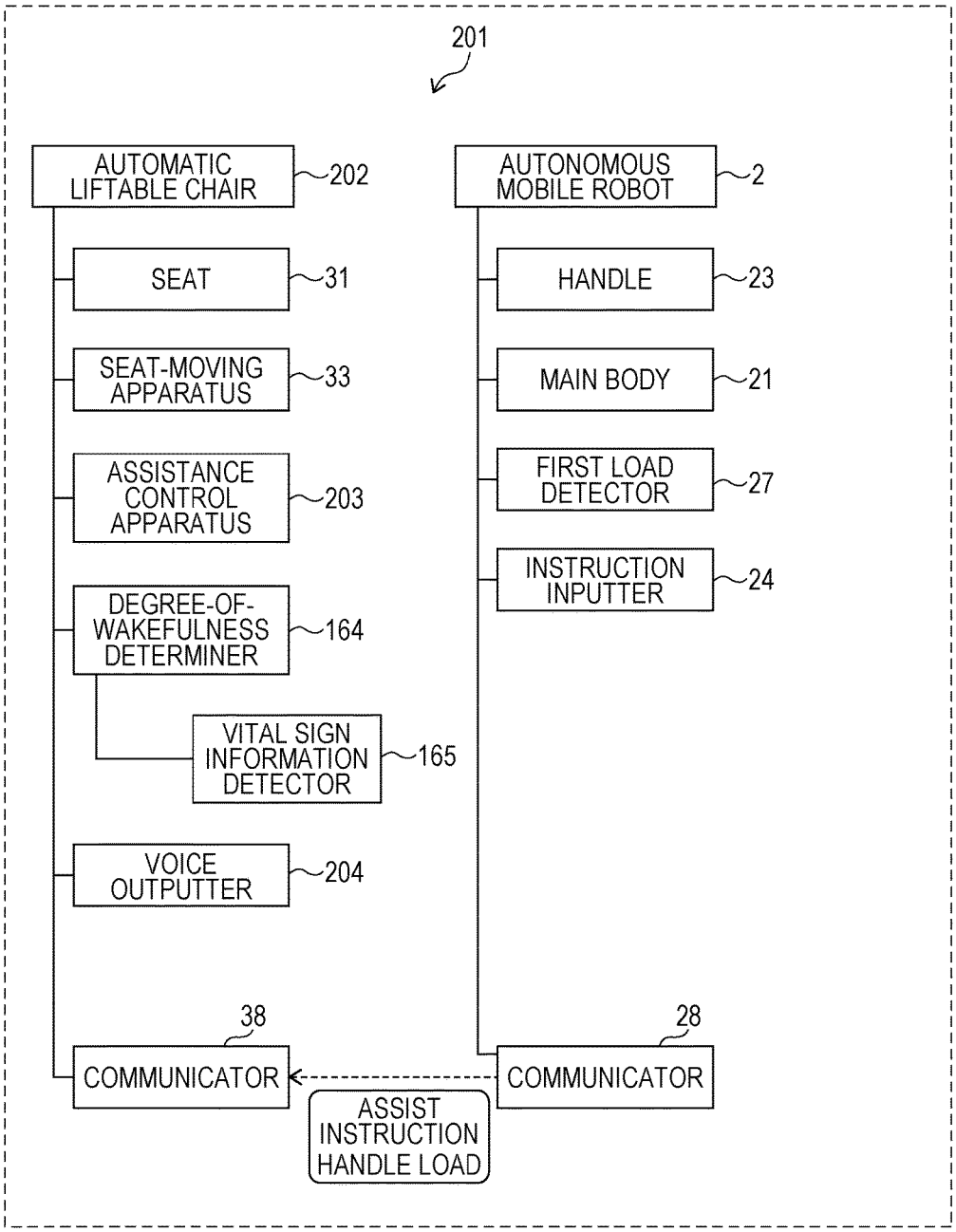
FIG. 20 is a control block diagram of a life assistance system of Embodiment 10 of the present disclosure.

FIG. 20 is a control block diagram of the life assistance system 201 according to Embodiment 10. Embodiment 10 differs from Embodiment 8 in that an assistance control apparatus 203 determines, on the basis of the degree of wakefulness of the user as determined by the degree-of-wakefulness determiner 164, whether to send a notice to the user by voice and that a voice outputter 204 outputs a voice to the user. Note here that a voice signal is a so-called auditory signal and needs only be information (signal) that the user can aurally recognize, examples of which include a signal representing a voice, a signal representing the volume of a sound, and the like.

Figure 21:
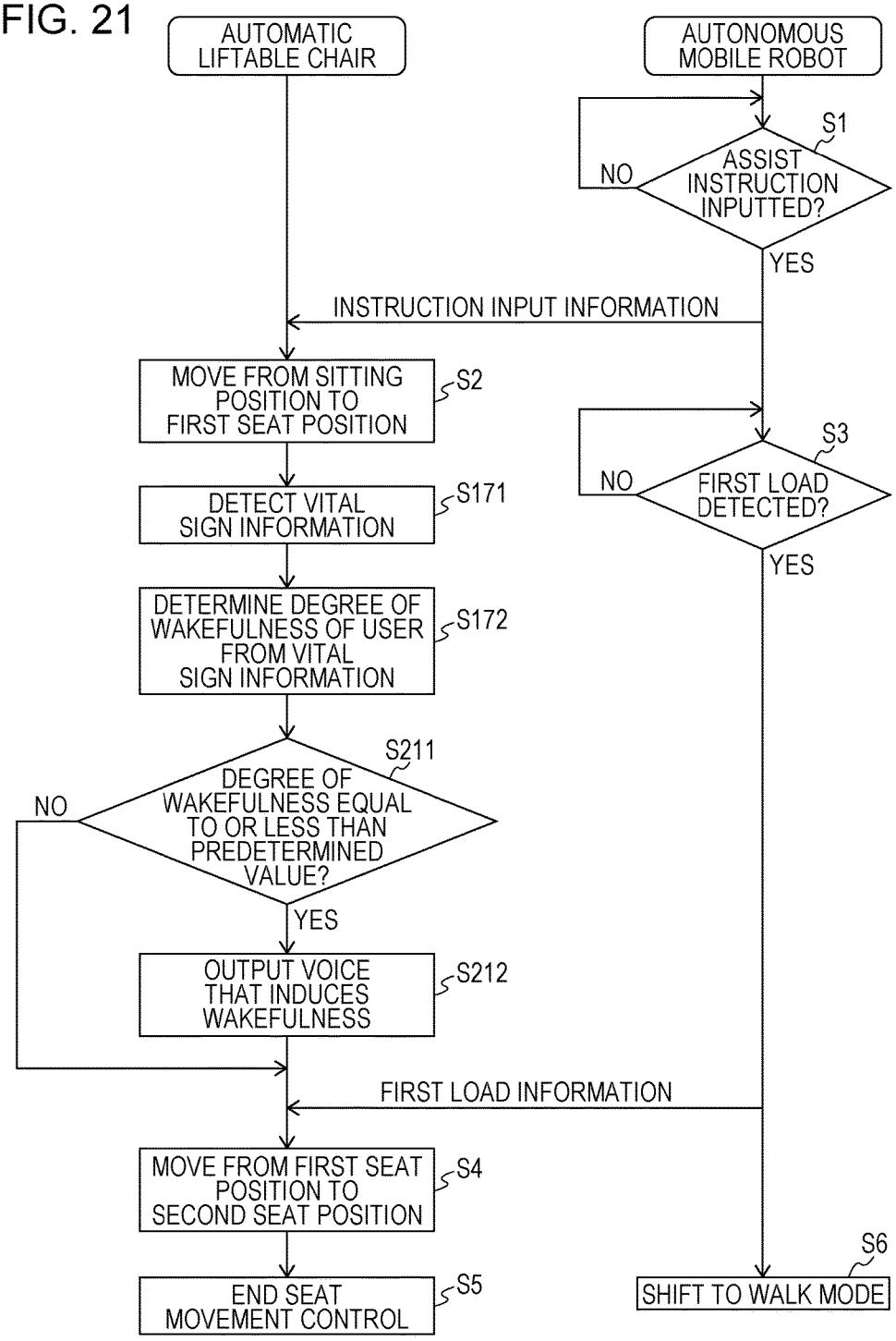
FIG. 21 is a flow chart showing an operation of the life assistance system of Embodiment 10.

FIG. 21 is a flow chart of operation of the life assistance system 201 according to Embodiment 10. First, the degree-of-wakefulness determiner 164 determines the degree of wakefulness of the user from the vital sign information detected by the vital sign information detector 165 (step S172). The assistance control apparatus 203 determines whether the degree of wakefulness is not greater than a predetermined value, and if the degree of wakefulness is not greater than the predetermined value, the assistance control apparatus 203 controls the voice outputter 204 to output a voice (step S211). In response to this, the voice outputter 204 outputs a voice to the user (step S212).

As described above, the life assistance system 201 according to Embodiment 10 of the present disclosure can induce the user into wakefulness in a case where the degree of wakefulness of the user is not sufficient, thus making it possible to enhance the safety during the action of moving the seat 31.

Embodiment 11

Next, a life assistance system 221 according to Embodiment 11 of the present disclosure is described with reference to a control block diagram of the life assistance system 221 in FIG. 22 and a flow chart of operation in FIG. 23. Components of the life assistance system 221 according to Embodiment 11 that are identical to those of the life assistance system 1 according to Embodiment 1 are given the same reference numerals and, as such, are not described below. The life assistance system 221 of Embodiment 11 is described below with a focus on the differences between the life assistance system 221 of Embodiment 11 and the life assistance system 1 of Embodiment 1.

Figure 22:
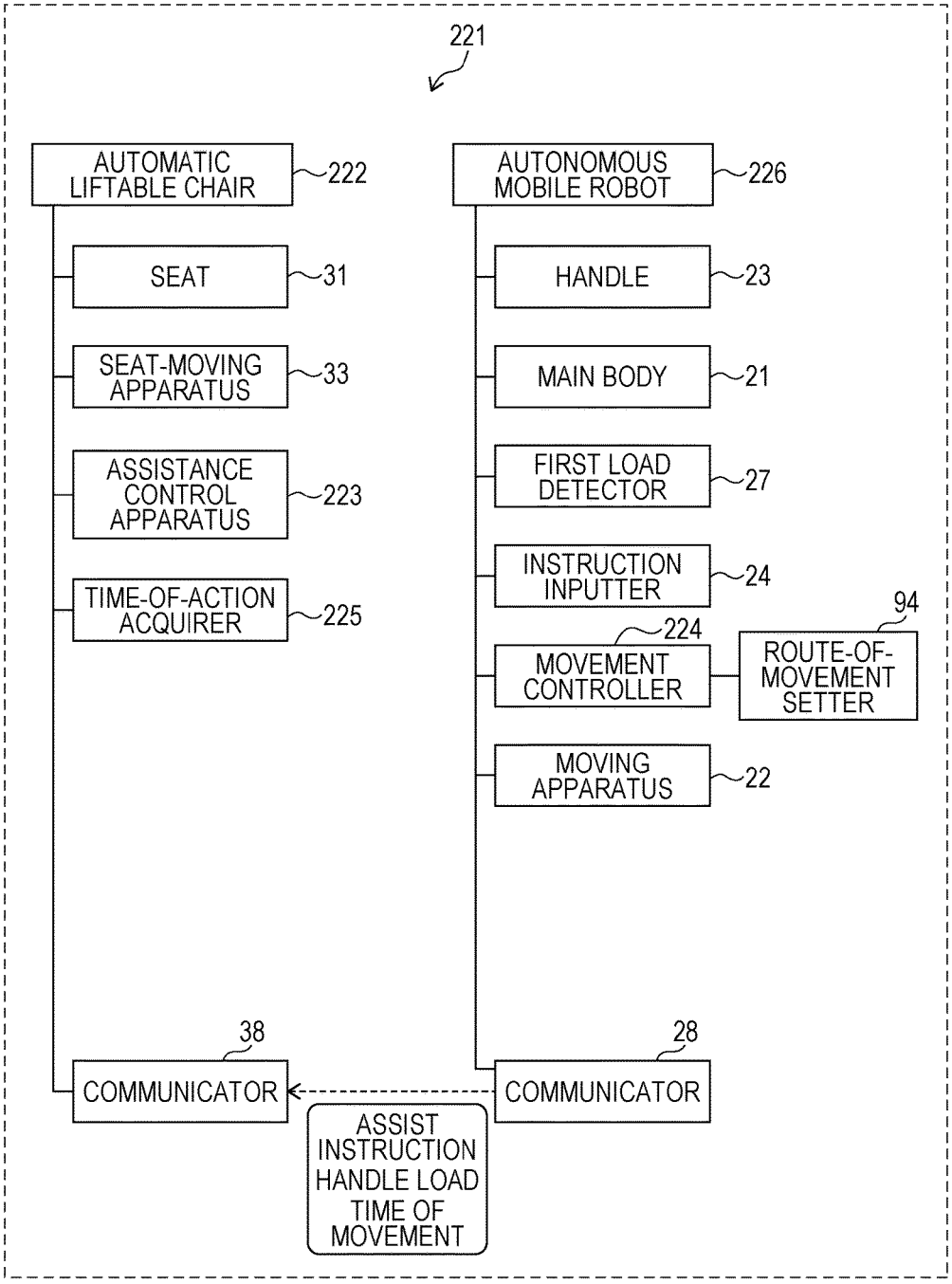
FIG. 22 is a control block diagram of a life assistance system of Embodiment 11 of the present disclosure.

FIG. 22 is a control block diagram of the life assistance system 221 according to Embodiment 11. In Embodiment 11, a time-of-action acquirer 225 of an automatic liftable chair 222 calculates a time (first time of action) required to complete the first assisting action, and a movement controller 224 of an autonomous mobile robot 226 calculates a time of movement based on the route of movement from the current location to the assisting place. Embodiment 11 differs from Embodiment 1 in that an assistance control apparatus 223 compares the aforementioned first time of action with the time of movement and, if the time of movement is longer than the first time of action, exercises control to slow down the speed of movement of the seat 31. Note here that the time of movement is calculated on the basis of the route of movement from the current location to the assisting place. Alternatively, the time of movement may be simply calculated by "distance of movement/speed of movement". Alternatively, if, in a case where the route of movement is curved, the speed of the autonomous mobile robot 226 changes according to the degree of curvature, the time of movement may be calculated with the degree of change taken into account. Further, the aforementioned time of action may be a value obtained by dividing, by the angular speed of seat movement, a change in seat angle that is to be made to reach the first seat position from the sitting position.

Figure 23:
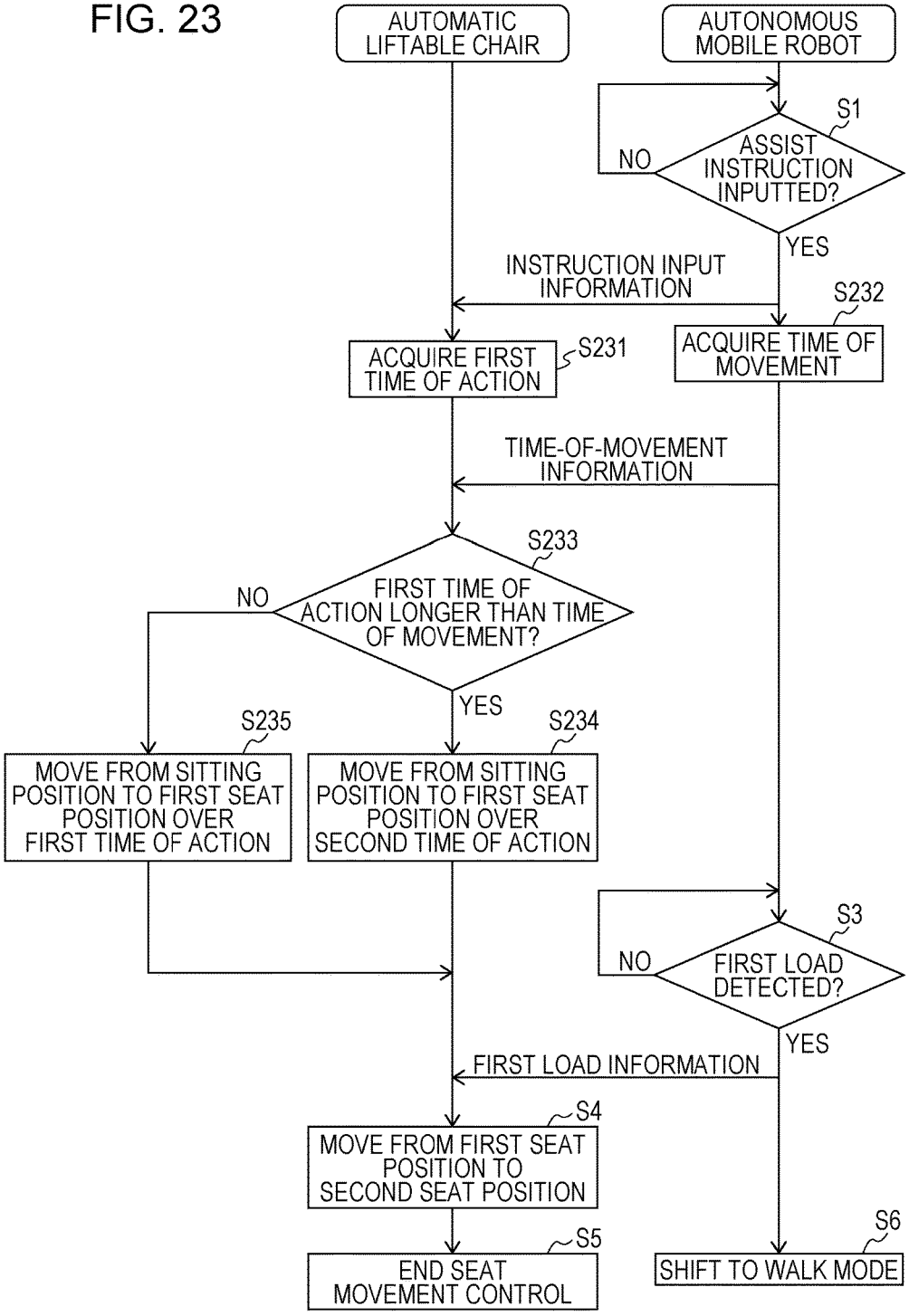
FIG. 23 is a flow chart showing an operation of the life assistance system of Embodiment 11.

FIG. 23 is a flow chart of operation of the life assistance system 221 according to Embodiment 11. First, the time-of-action acquirer 225 of the automatic liftable chair 222 calculates a time (first time of action) it takes the seat 31 to reach the first seat position from the sitting position by moving (step S231). Further, the movement controller 224 of the autonomous mobile robot 226 calculates, on the basis of the route of movement thus obtained, a time (time of movement) it takes to move from the current location to the assisting place (step S232). The assistance control apparatus 223 compares the first time of action with the time of movement sent via the communicator 38 (step S233) and, if the first time of action is shorter than the time of movement, exercises control to move the seat 31 from the sitting position to the first seat position over a longer time (second time of action) than usual (step S234). It should be noted that if the comparison result is opposite, the assistance control apparatus 223 exercises control to move the seat 31 over a usual time (first time of action) (step S235). Note here that, as is clear from the above descriptions, taking the second time of action means slowly moving the seat 31 in the case of late arrival of the autonomous mobile robot 226.

As described above, the life assistance system 221 according to Embodiment 11 makes it possible shift from the first assisting action to the second assisting action in a way that is smooth for the user, as the arrival of the autonomous mobile robot 226 and the arrival of the automatic liftable chair 222 at the first seat position are near in time.

Embodiment 12

Next, a life assistance system 241 according to Embodiment 12 of the present disclosure is described with reference to a control block diagram of the life assistance system 241 in FIG. 24 and a flow chart of operation in FIG. 25. Components of the life assistance system 241 according to Embodiment 12 that are identical to those of the life assistance system 1 according to Embodiment 1 are given the same reference numerals and, as such, are not described below. The life assistance system 241 of Embodiment 12 is described below with a focus on the differences between the life assistance system 241 of Embodiment 12 and the life assistance system 1 of Embodiment 1.

Figure 24:
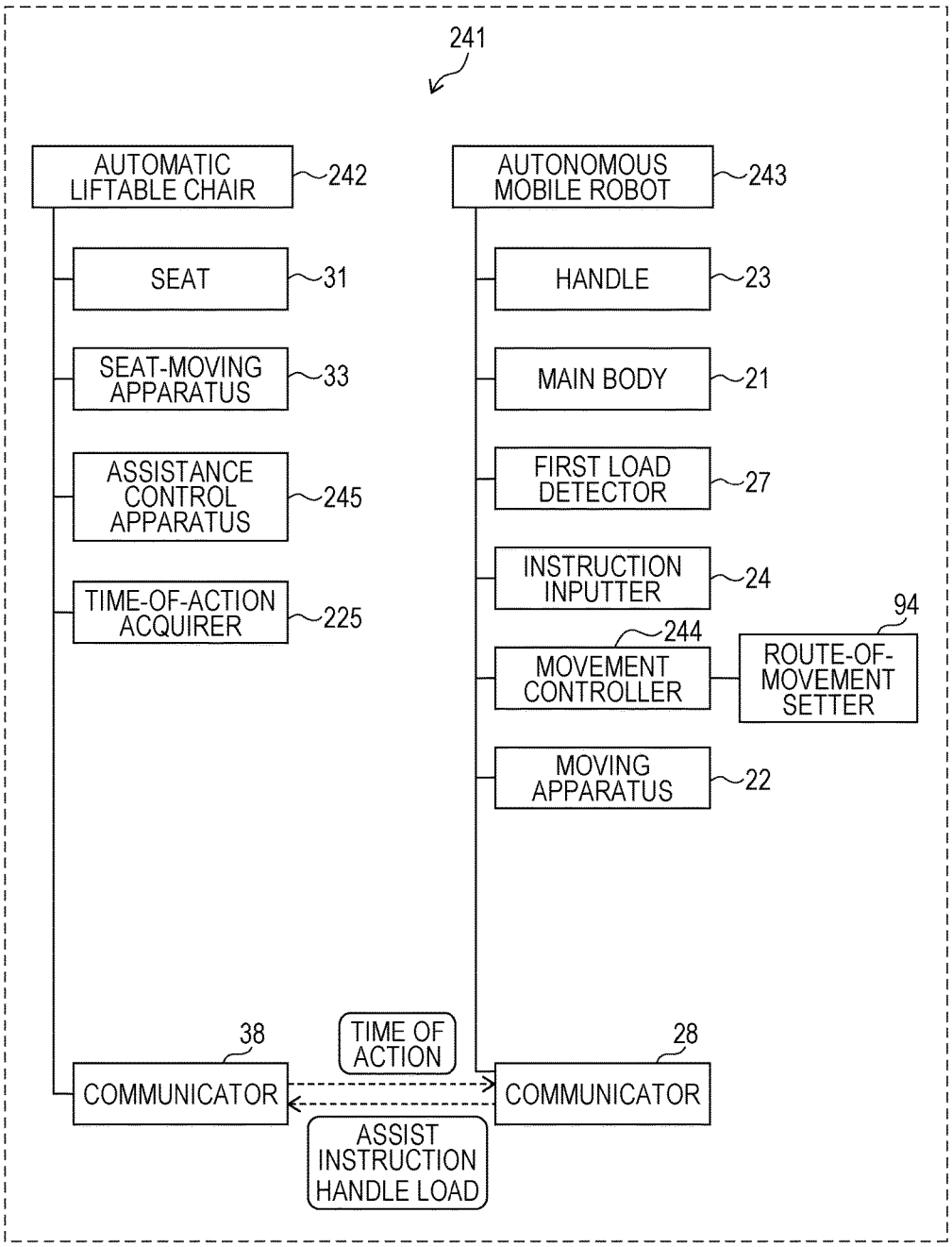
FIG. 24 is a control block diagram of a life assistance system of Embodiment 12 of the present disclosure.

FIG. 24 is a control block diagram of the life assistance system 241 according to Embodiment 12. Embodiment 12 differs from Embodiment 1 in that a movement controller 244 of an autonomous mobile robot 243 adjusts the speed of movement of the autonomous mobile robot 243 from the current location to the assisting place by using the "time required for the stand-up action from the sitting position to the first seat position" acquired by the time-of-action acquirer 225 of an automatic liftable chair 242. For that purpose, the movement controller 244 compares the aforementioned "time required for the stand-up action of the automatic liftable chair 242" with the "time of movement from the current location to the assisting place" of the autonomous mobile robot 243 as calculated by the route-of-movement setter 94. In a case where the times are different from each other, the movement controller 244 adjusts the speed of movement of the autonomous mobile robot 243 so that the point in time where the assisting place is reached coincides with the point in time where the stand-up action ends. Specifically, in a case where the aforementioned times are different from each other, the temporal difference (Δt: time of movement of robot-aforementioned time of action) is calculated, and the speed of movement is calculated according to Eq. 1:

$$\Delta v = \Delta t / t \times v. \quad \text{(Eq. 1):}$$

Note here that Δv is the amount of change in speed of movement of the autonomous mobile robot 243, that t is the aforementioned time of action, and that v is the normal speed of movement (first speed of movement) of the autonomous mobile robot 243. It should be noted that in a case where the route of movement is bent, the settings may be configured such that the speed of movement is accelerated only in a straight part of the route of movement, although the above calculation result assumes that the speed of movement of the robot 243 is based on a uniform motion (the speed is constant). This is because accelerating at a curve poses a higher risk.

Figure 25:
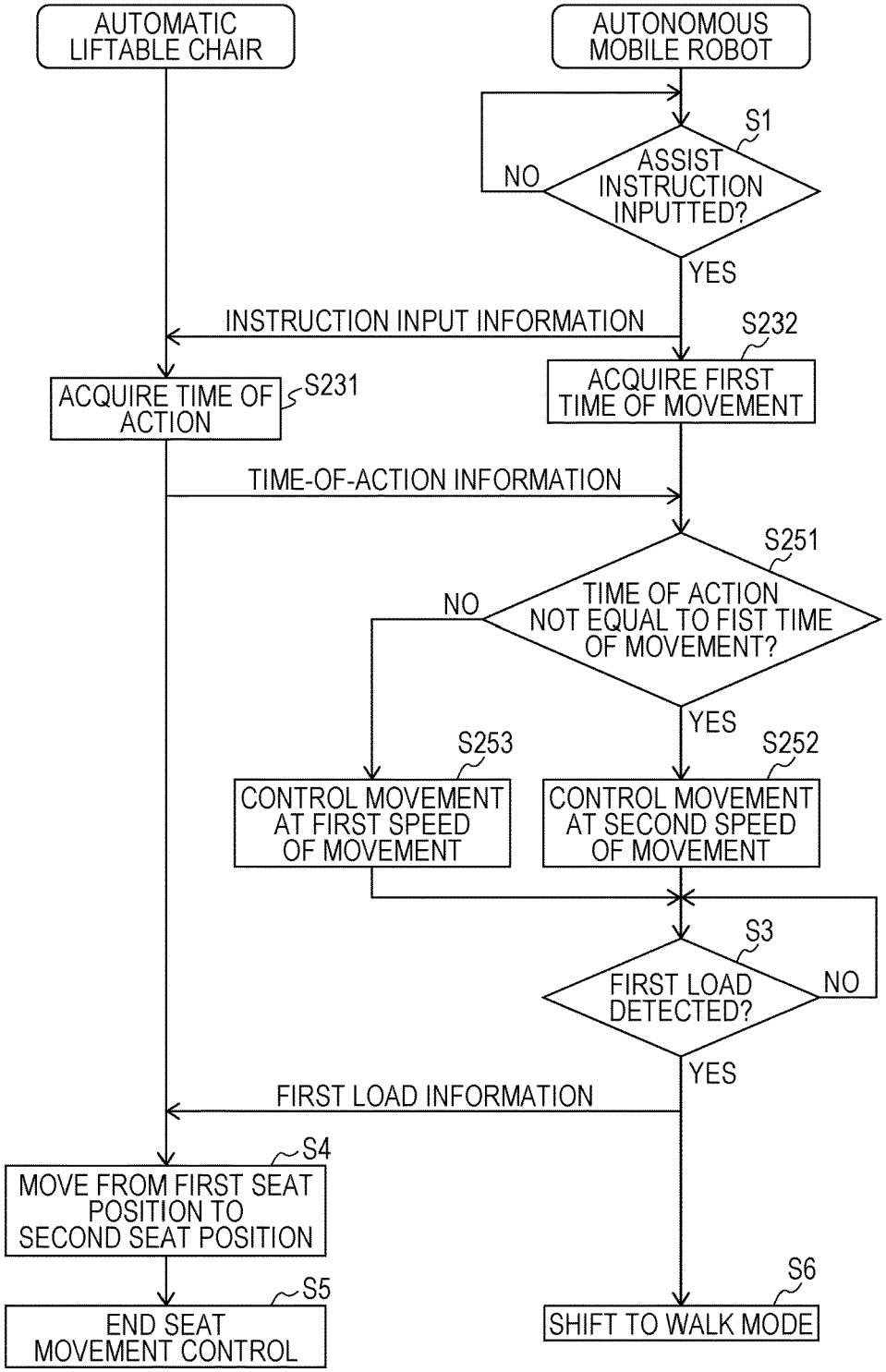
FIG. 25 is a flow chart showing an operation of the life assistance system of Embodiment 12.

FIG. 25 is a flow chart of operation of the life assistance system 241 according to Embodiment 12. First, the time-of-action acquirer 225 of the automatic liftable chair 242 acquires a time (time of action) it takes to move from the sitting position to the first seat position (step S231). Next, the movement controller 244 of the autonomous mobile robot 243 calculates a time (first time of movement) required to reach the assisting place from the current location (step S232). Next, an assistance control apparatus 245 sends the time of action to the autonomous mobile robot 243 via the communicator 38. By using the time of action received via the communicator 28, the movement controller 244 compares the time of action with the first time of movement (step S251). In a case where, as a result of the comparison, the times are different from each other, the movement controller 244 changes the speed of movement (first speed of movement) of the autonomous mobile robot 243 into a form shown in Eq. 1 and performs movement control at a second speed of movement (step S252). It should be noted that in a case where the times are the same, the movement controller 244 performs movement control at the first speed of movement (step S253).

As described above, the life assistance system 241 according to Embodiment 12 makes it possible to shift from the first assisting action to the second assisting action in a way that is smooth for the user, as the arrival of the autonomous mobile robot 243 and the arrival of the automatic liftable chair 242 at the first seat position are near in time.

Embodiment 13

Next, a life assistance system 271 according to Embodiment 13 of the present disclosure is described with reference to an appearance diagram of an autonomous mobile robot 276 in FIG. 26, a control block diagram of the life assistance system 271 in FIG. 27, and a flow chart of operation in FIG. 28. Components of the life assistance system 271 according to Embodiment 13 that are identical to those of the life assistance system 1 according to Embodiment 1 are given the same reference numerals and, as such, are not described below. The life assistance system 271 of Embodiment 13 is described below with a focus on the differences between the life assistance system 271 of Embodiment 13 and the life assistance system 1 of Embodiment 1.

Figure 26:
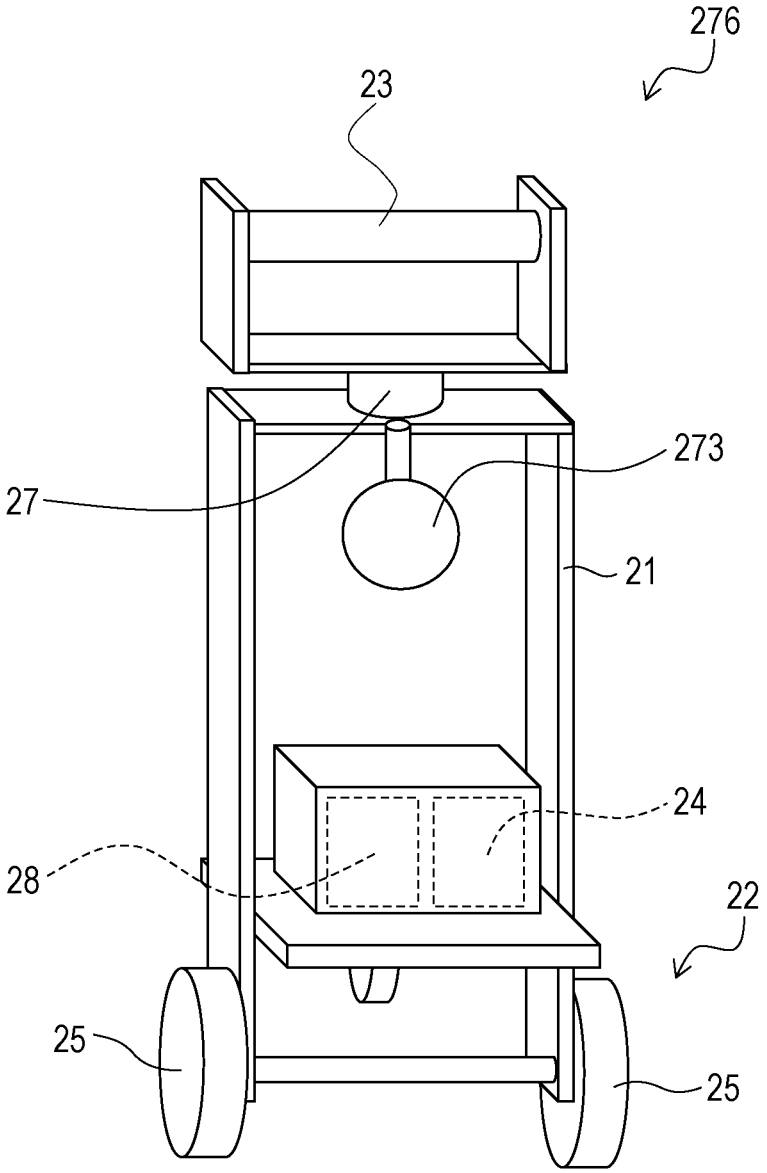
FIG. 26 is an appearance diagram of an autonomous mobile robot of Embodiment 13 of the present disclosure.

FIG. 26 is an appearance diagram of the autonomous mobile robot 276. In FIG. 26, the reference numeral 273 refers to a first light emitter, and the first light emitter 273 has a function of notifying the user that the autonomous mobile robot 276 is prepared to execute stand-up assistance very soon. Note here that instead of being an LED, a light bulb, or the like, the first light emitter 273 needs only be information (signal) that the user can visually recognize, such as a signal representing the intensity of light or a signal representing a difference in emission color.

Figure 27:
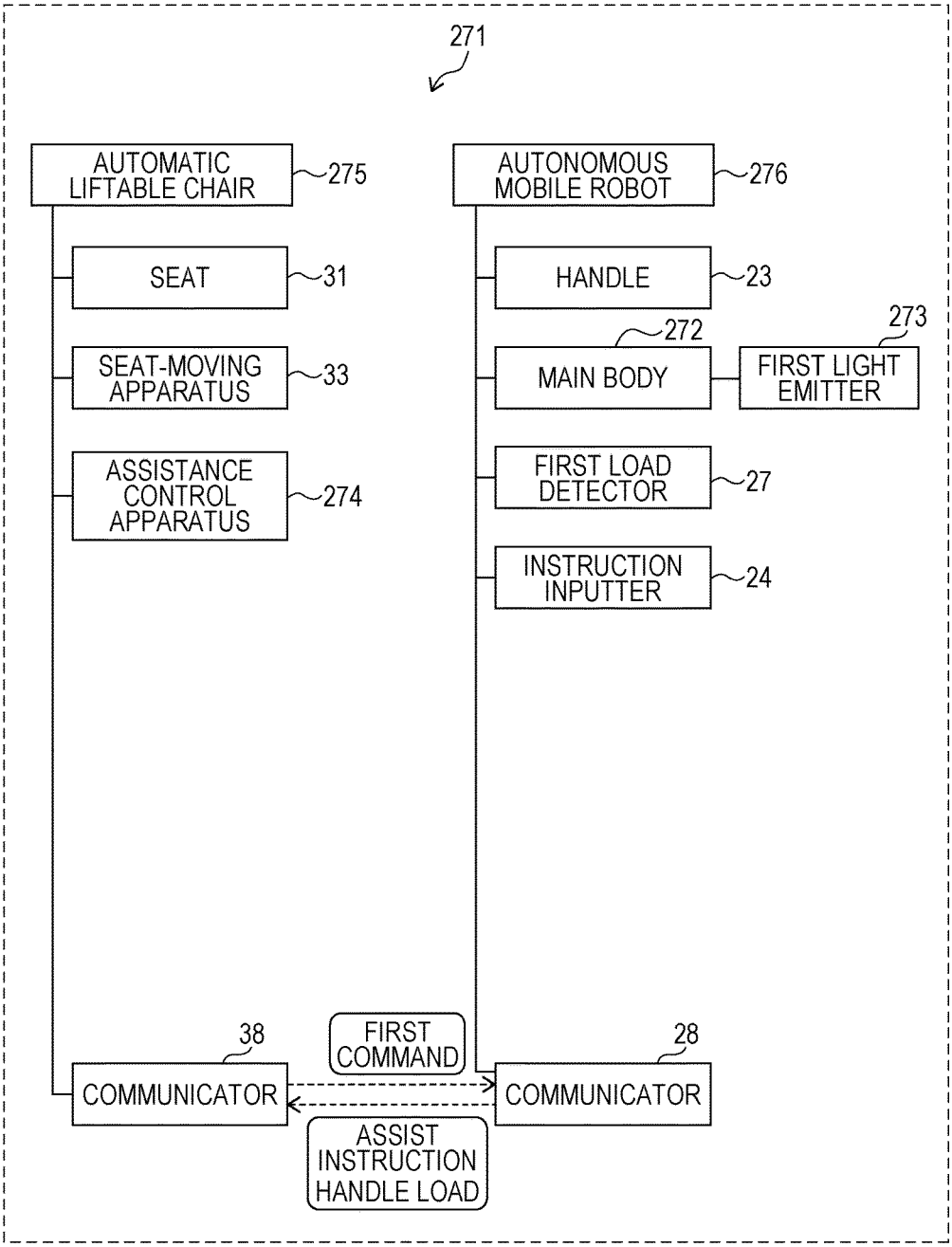
FIG. 27 is a control block diagram of a life assistance system of Embodiment 13.

FIG. 27 is a control block diagram of the life assistance system 271 in Embodiment 13. In Embodiment 13, an assistance control apparatus 274 notifies the autonomous mobile robot 276 via the communicator 38 of a first command to the effect that "an automatic liftable chair 275 has started to move from the sitting position to the first seat position". On the basis of this first command, a main body 272 of the autonomous mobile robot 276 is controlled to cause the first light emitter 273 to emit light. This is a point of difference between Embodiment 13 and Embodiment 1. Note here that the timing of notification of the first command and emission of the first light emitter 273 may be some point during the movement, as well as a point in time where the aforementioned movement was started. In other words, the timing of emission needs only be a time with which the user does not feel a sense of incompatibility.

Figure 28:
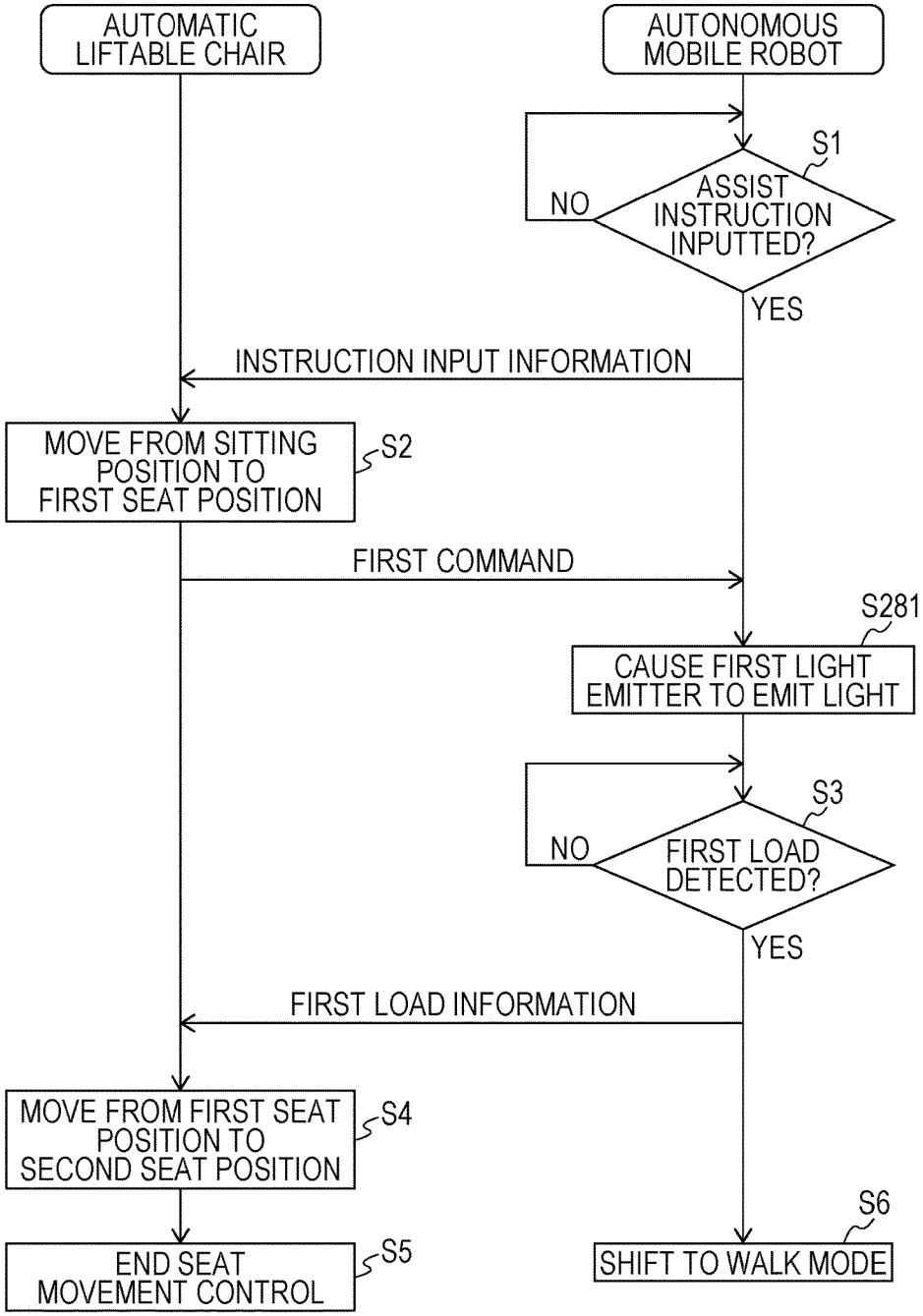
FIG. 28 is a flow chart showing an operation of the life assistance system of Embodiment 13.

FIG. 28 is a flow chart of operation of the life assistance system 271 according to Embodiment 13. At a stage where the automatic liftable chair 275 moves from the sitting position to the first seat position, the assistance control apparatus 274 outputs the first command to that effect. The main body 272 of the autonomous mobile robot 276, which has received the first command via the communicator 28, causes the first light emitter 273 to emit light (step S281).

As described above, the life assistance system 271 according to Embodiment 13 allows the user to recognize, in an easy-to-understand manner, that a stand-up action is performed very soon.

Embodiment 14

Next, a life assistance system 301 according to Embodiment 14 of the present disclosure is described with reference to an appearance diagram of an autonomous mobile robot 303 in FIG. 29, a control block diagram of the life assistance system 301 in FIG. 30, and a flow chart of operation in FIG. 31. Components of the life assistance system 301 according to Embodiment 14 that are identical to those of the life assistance system 271 according to Embodiment 13 are given the same reference numerals and, as such, are not described below. The life assistance system 301 of Embodiment 14 is described below with a focus on the differences between the life assistance system 301 of Embodiment 14 and the life assistance system 271 of Embodiment 13.

Figure 29:
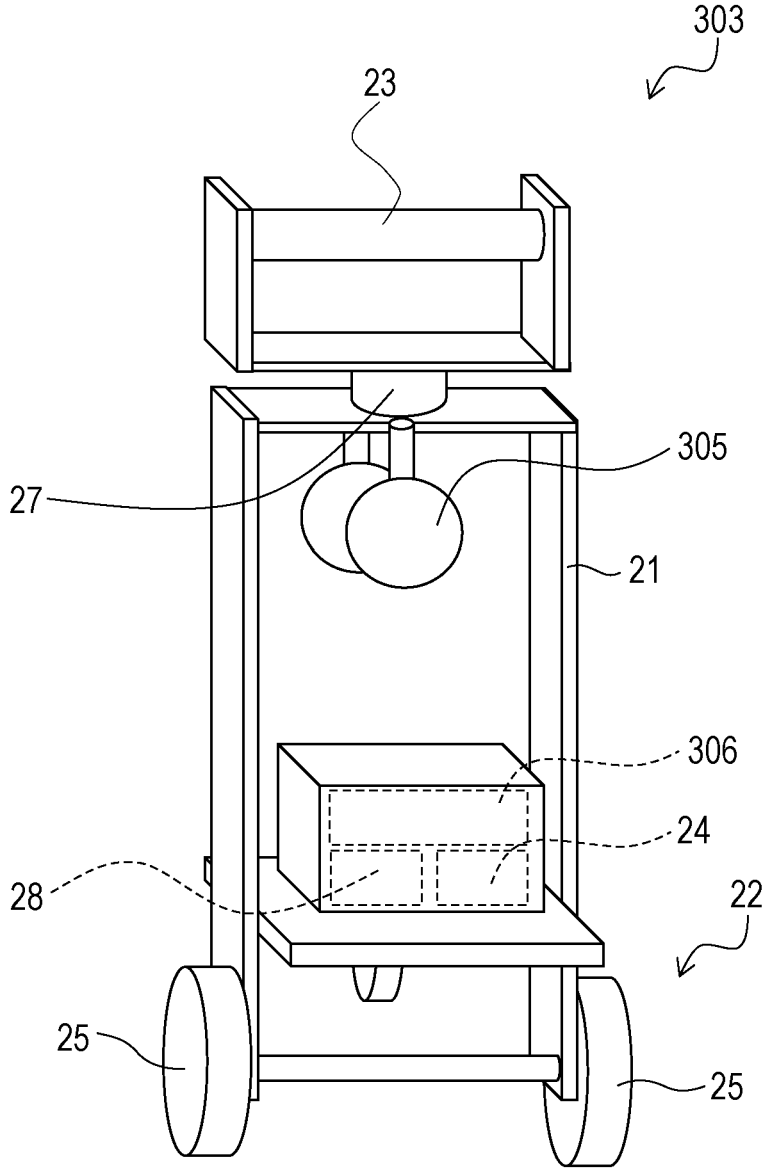
FIG. 29 is an appearance diagram of an autonomous mobile robot of Embodiment 14 of the present disclosure.

FIG. 29 is an appearance diagram of the autonomous mobile robot 303. In FIG. 29, the reference numeral 305 refers to first light emitters provided facing in such directions as to illuminate the front and back surfaces, respectively, of the autonomous mobile robot 303 (the front and back surfaces being upper and lower sides, respectively, of the perpendicular to the paper plane of FIG. 29). Note here that first light emitters may be disposed in the back and front, respectively, of a single housing, although FIG. 29 illustrates the two first light emitters 305 for use on the front and back surfaces. Illuminants of the first light emitters 305 are the same as that of the light emitter 273 of the autonomous mobile robot 276 in Embodiment 13. Further, the reference numeral 306 refers to a surface determiner that determines whether the autonomous mobile robot 303 squarely faces the automatic liftable chair 275.

Figure 30:
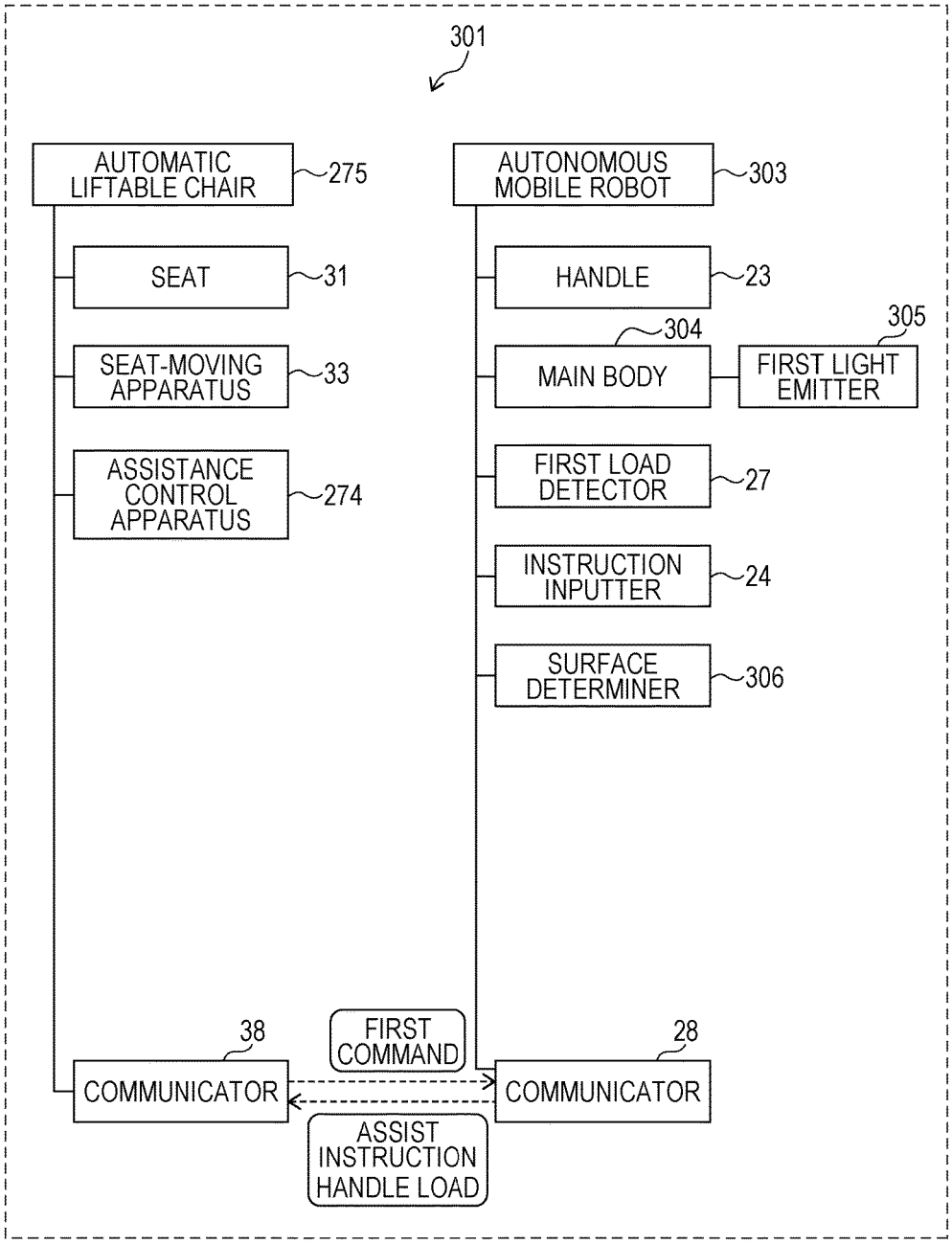
FIG. 30 is a control block diagram of a life assistance system of Embodiment 14.

FIG. 30 is a control block diagram of the life assistance system 301 in Embodiment 14. In Embodiment 14, the surface determiner 306 determines whether the front or back surface of the autonomous mobile robot 303 faces the automatic liftable chair 275. On the basis of a determination result yielded by the surface determiner 306, light is emitted by that one of the first light emitters 305 which can be seen from the user sitting on the automatic liftable chair 275. This is a point of difference between Embodiment 14 and Embodiment 13. Note here that the surface determiner 306 irradiates an infrared sensor, a radio-frequency sensor, or the like (not illustrated) mounted on the autonomous mobile robot 303, analyzes information on the reflection, and thereby determines which surface faces the automatic liftable chair 275. It should be noted that the technology for determining a surface is not limited to the aforementioned method, as there is another technology for determining a surface. For example, the technology for determining a surface may alternatively be achieved by putting a particular mark on the automatic liftable chair 275 in advance, mounting the autonomous mobile robot 303 with an imaging device (not illustrated) that can take images of places that are in front of and behind the autonomous mobile robot 303, taking images of the places, analyzing the images to see whether the mark has been photographed, and determining that the side from which the mark has been photographed faces the automatic liftable chair 275.

Figure 31:
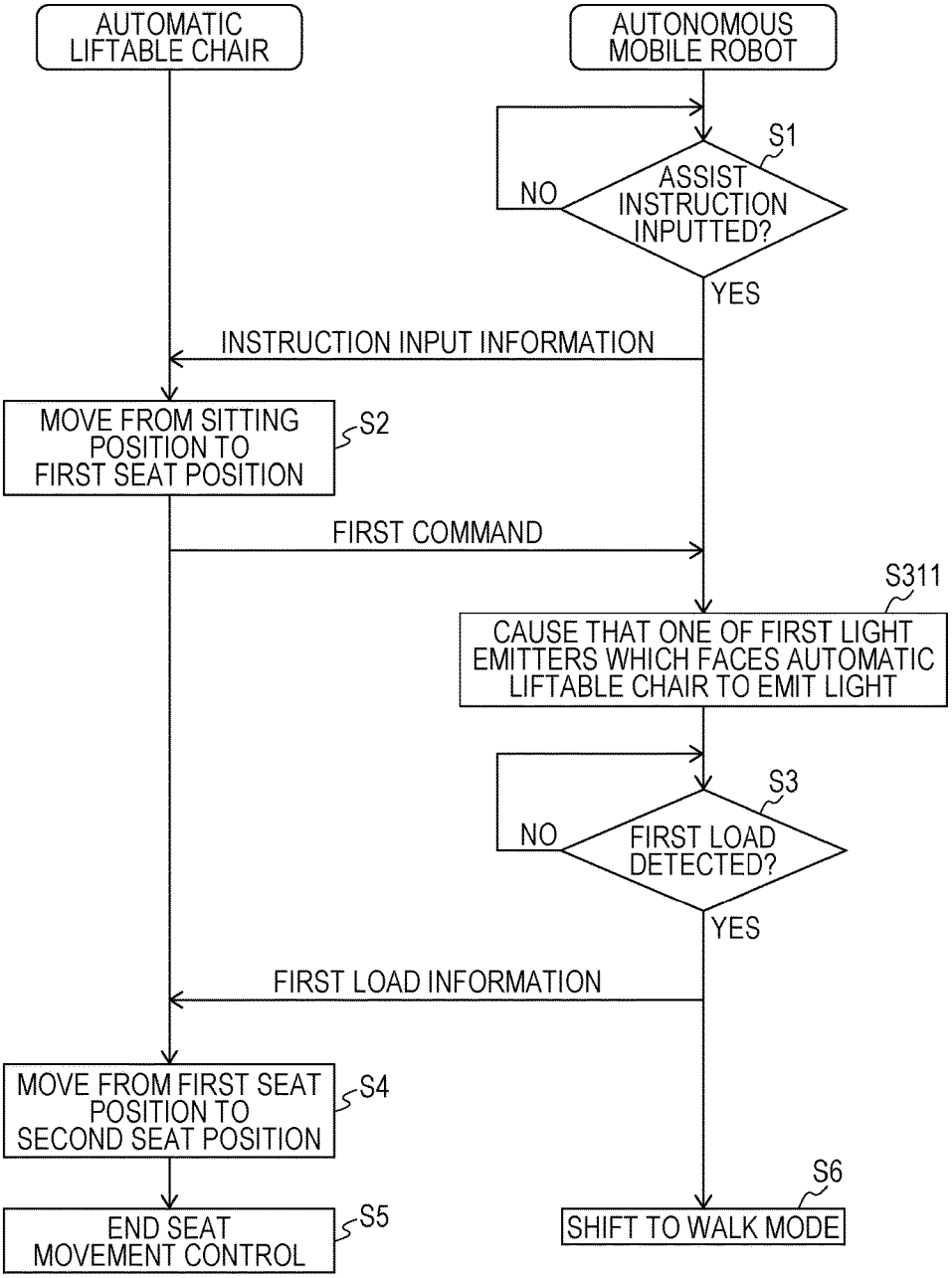
FIG. 31 is a flow chart showing an operation of the life assistance system of Embodiment 14.

FIG. 31 is a flow chart of operation of the life assistance system 301 according to Embodiment 14. On the basis of a determination result yielded by the surface determiner 306, a main body 304, which has received the first command communicated via the communicator 28, causes that one of the first light emitters 305 which faces the automatic liftable chair 275 to emit light (step S311).

This allows the user to recognize that the autonomous mobile robot 303 is in a walk assist state.

Embodiment 15

Next, a life assistance system 331 according to Embodiment 15 of the present disclosure is described with reference to an appearance diagram of an autonomous mobile robot 333 in FIG. 32, a control block diagram of the life assistance system 331 in FIG. 33, and a flow chart of operation in FIG. 34. Components of the life assistance system 331 according to Embodiment 15 that are identical to those of the life assistance system 1 according to Embodiment 1 are given the same reference numerals and, as such, are not described below. The life assistance system 331 of Embodiment 15 is described below with a focus on the differences between the life assistance system 331 of Embodiment 15 and the life assistance system 1 of Embodiment 1.

Figure 32:
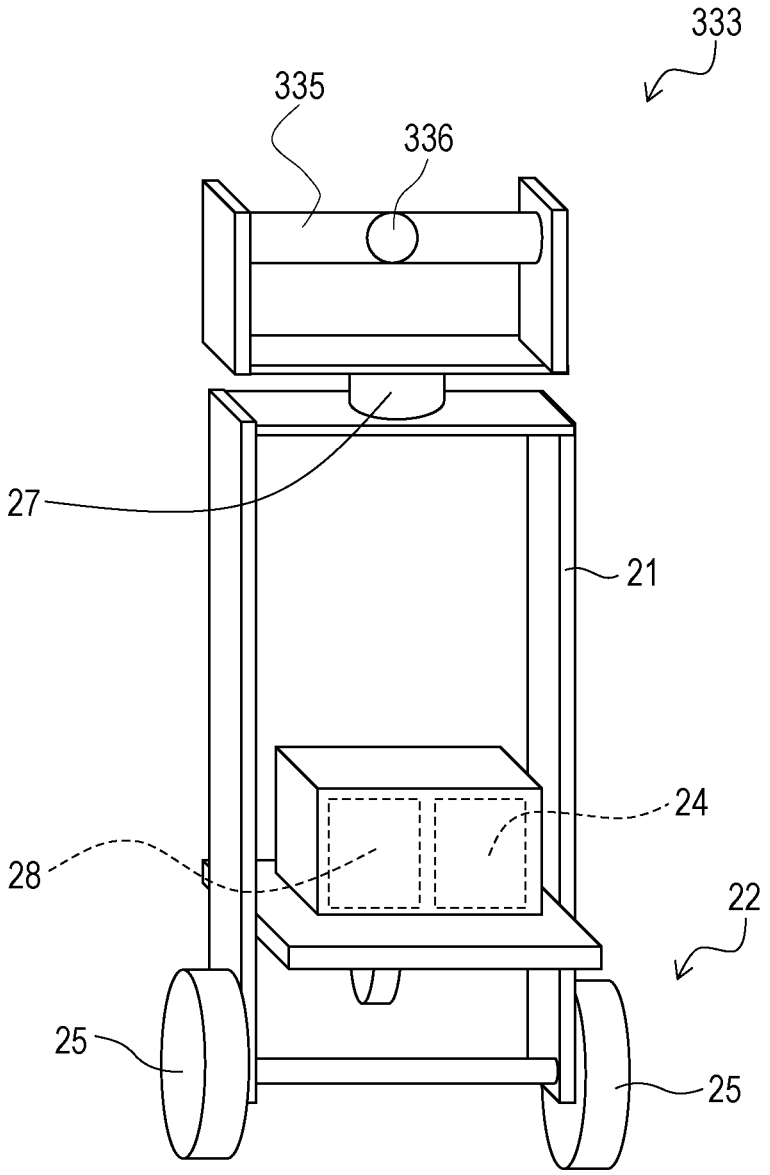
FIG. 32 is an appearance diagram of an autonomous mobile robot of Embodiment 15 of the present disclosure.

FIG. 32 is an appearance diagram of the autonomous mobile robot 333. In FIG. 32, the reference numeral 336 refers to a second light emitter provided in a handle 335. The second light emitter 336 is not described in detail here as it is identical to the aforementioned first light emitters. This second light emitter 336 serves to notify the user that the life assistance system 331 can shift to the second assisting action. That is, by glowing or blinking, the second light emitter 336 allows the user to recognize that it is a timing for gripping the handle 335, thus allowing the user to assuredly take an action to grip the handle 335.

Figure 33:
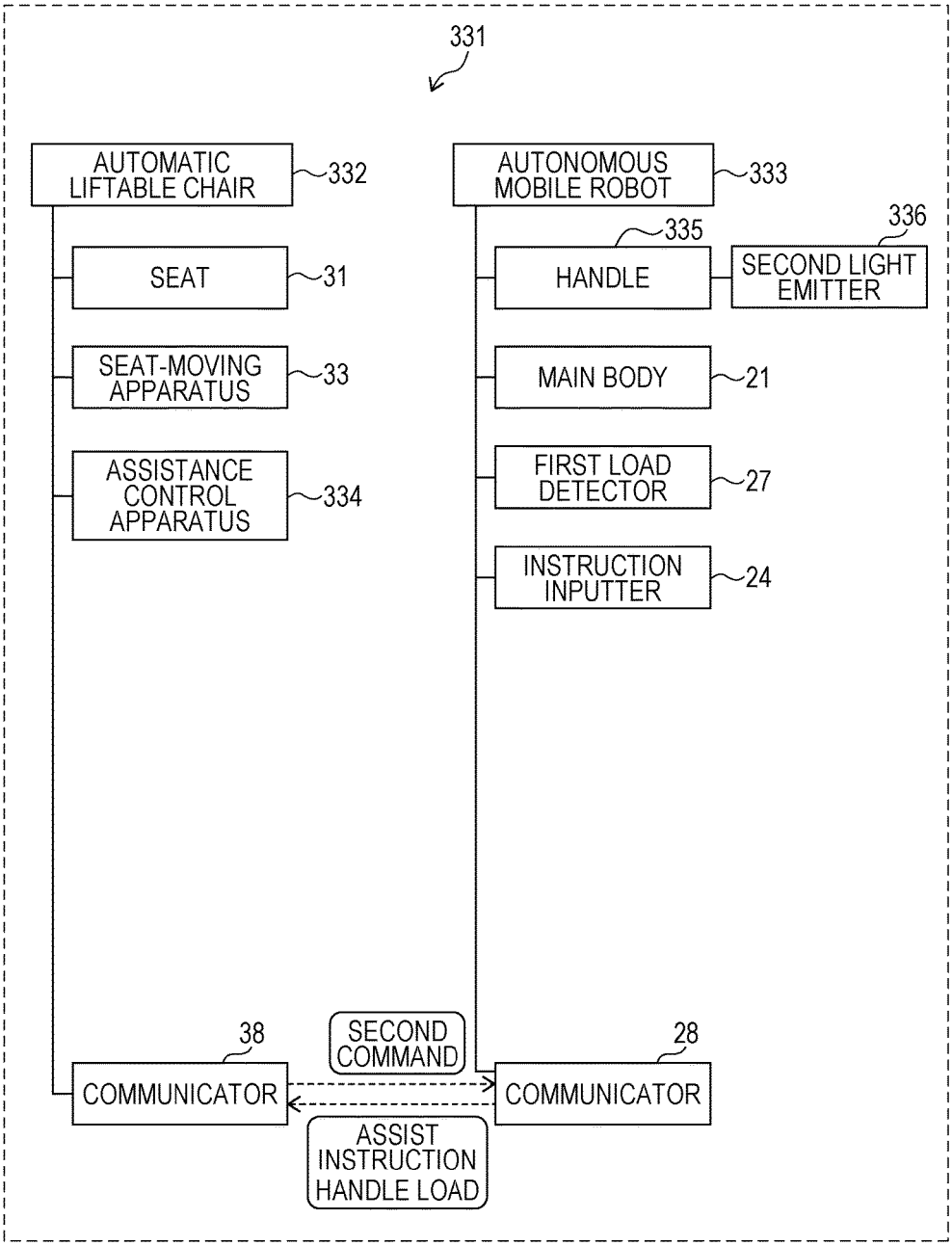
FIG. 33 is a control block diagram of a life assistance system of Embodiment 15.

FIG. 33 is a control block diagram of the life assistance system 331 in Embodiment 15. In Embodiment 15, the handle 335 is provided with the second light emitter 336. Furthermore, an assistance control apparatus 334 of an automatic liftable chair 332 sends a second command to the autonomous mobile robot 333 through the communicator 38 to the effect that the first assisting action has been completed. In response to this second command, the handle 335 of the autonomous mobile robot 333 is controlled to cause the second light emitter 336 to emit light. This is a point of difference between Embodiment 15 and Embodiment 1.

Figure 34:
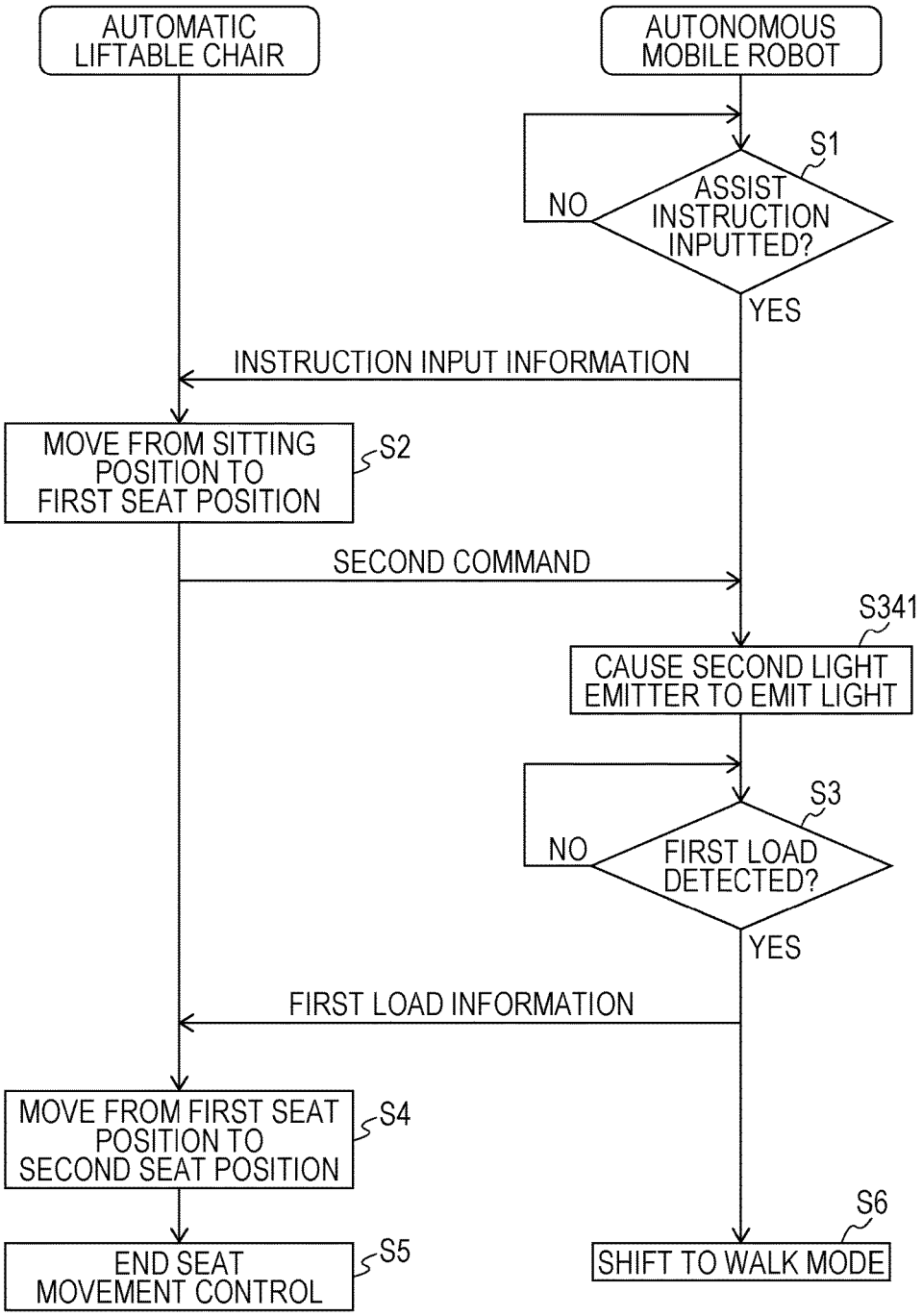
FIG. 34 is a flow chart showing an operation of the life assistance system of Embodiment 15.

FIG. 34 is a flow chart of operation of the life assistance system 331 according to Embodiment 15. At a stage where the automatic liftable chair 332 has completed the first assisting action, the assistance control apparatus 334 of the chair 332 outputs the second command via the communicator 38. Upon receiving the aforementioned second command, the handle 335 of the autonomous mobile robot 333 exercises control to cause the second light emitter 336 to emit light (step S341). It should be noted that although the foregoing description assumes that the control of emission of the second light emitter 336 is performed by the handle 335, this does not imply any limitation. Such control may be performed by a movement controller (not illustrated) or by communication from such a controller provided outside the autonomous mobile robot 333.

As described above, the life assistance system 331 according to Embodiment 15 allows the user to recognize, in an easy-to-understand manner, the position where the handle 335 is when he/she is supposed to grip the handle 335 and the timing for gripping the handle 335.

Embodiment 16

Next, a life assistance system 401 according to Embodiment 16 of the present disclosure is described with reference to a control block diagram shown in FIG. 35. Components of the life assistance system 401 according to Embodiment 16 that are identical to those of the life assistance system 161 according to Embodiment 8 are given the same reference numerals and, as such, are not described below. The life assistance system 401 of Embodiment 16 is described below with a focus on the differences between the life assistance system 401 of Embodiment 16 and the life assistance system 161 of Embodiment 8.

Figure 35:
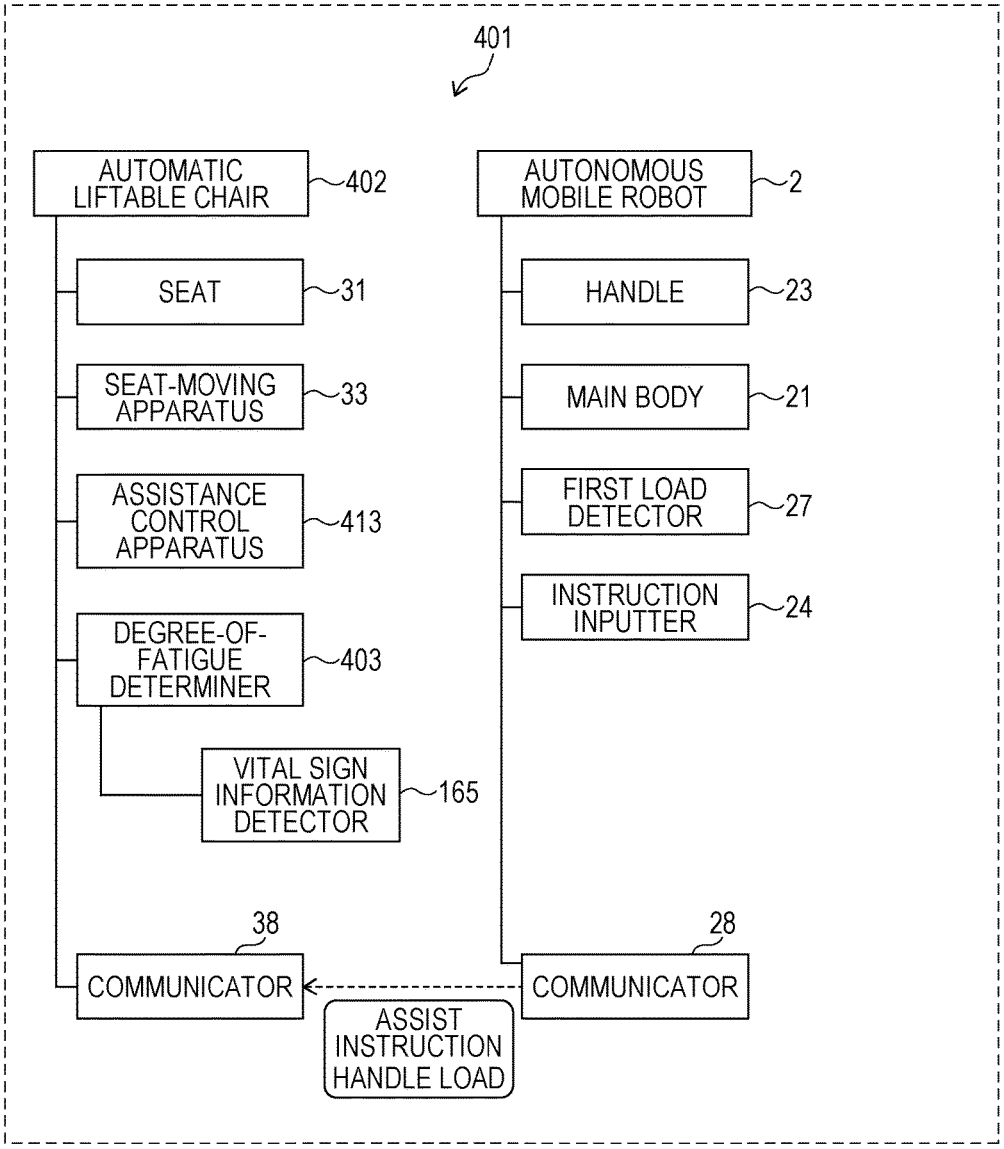
FIG. 35 is a control block diagram of a life assistance system of Embodiment 16 of the present disclosure.

As shown in FIG. 35, the life assistance system 401 according to Embodiment 16 differs from Embodiment 8 in that an automatic liftable chair 402 includes the vital sign information detector 165 and a degree-of-fatigue determiner 403 and that an assistance control apparatus 413 controls the speed of movement of the seat 31 on the basis of information acquired from the vital sign information detector 165 and the degree-of-fatigue determiner 403. In particular, the life assistance system 401 according to Embodiment 16 differs from Embodiment 8 in that the assistance control apparatus 413 controls the speed of movement of the seat 31 on the basis of not the degree of wakefulness of the user, but a degree of fatigue of the user.

The vital sign information detector 165 detects an immediate load change (body motion), pulse rate, heartbeat, respiration rate, or the like. The degree-of-fatigue determiner 403 determines the degree of fatigue of the user from vital sign information detected. For example, in a case where the pulse rate or the heartbeat is used as the vital sign information, the degree-of-fatigue determiner 403 may determine the degree of fatigue from a balance (ratio) between an HF component and an LF component. For example, in a case where LF component/HF component >2.5, the degree-of-fatigue determiner 403 may determine that the degree of fatigue is high.

In a case where the degree-of-fatigue determiner 403 has determined that the degree of fatigue is high, the assistance control apparatus 413 exercises control to determine the speed of movement of the seat 31 on the basis of the degree of fatigue of the user thus determined. Specifically, the higher the degree of fatigue becomes, the slower the speed of movement of the seat 31 becomes.

As described above, the life assistance system 401 according to Embodiment 16 of the present disclosure allows the automatic liftable chair 402 to, in providing stand-up assistance, move the seat 31 at a speed corresponding to the degree of fatigue of the user. This for example prevents the user from being taken by surprise at a rapid speed when he/she has a high degree of fatigue, thus making it possible to more safely execute the stand-up action.

Embodiment 17

Next, a life assistance system 451 according to Embodiment 17 of the present disclosure is described with reference to a control block diagram shown in FIG. 36. Components of the life assistance system 451 according to Embodiment 17 that are identical to those of the life assistance system 1 according to Embodiment 1 are given the same reference numerals and, as such, are not described below. The life assistance system 451 of Embodiment 17 is described below with a focus on the differences between the life assistance system 451 of Embodiment 17 and the life assistance system 1 of Embodiment 1.

Figure 36:
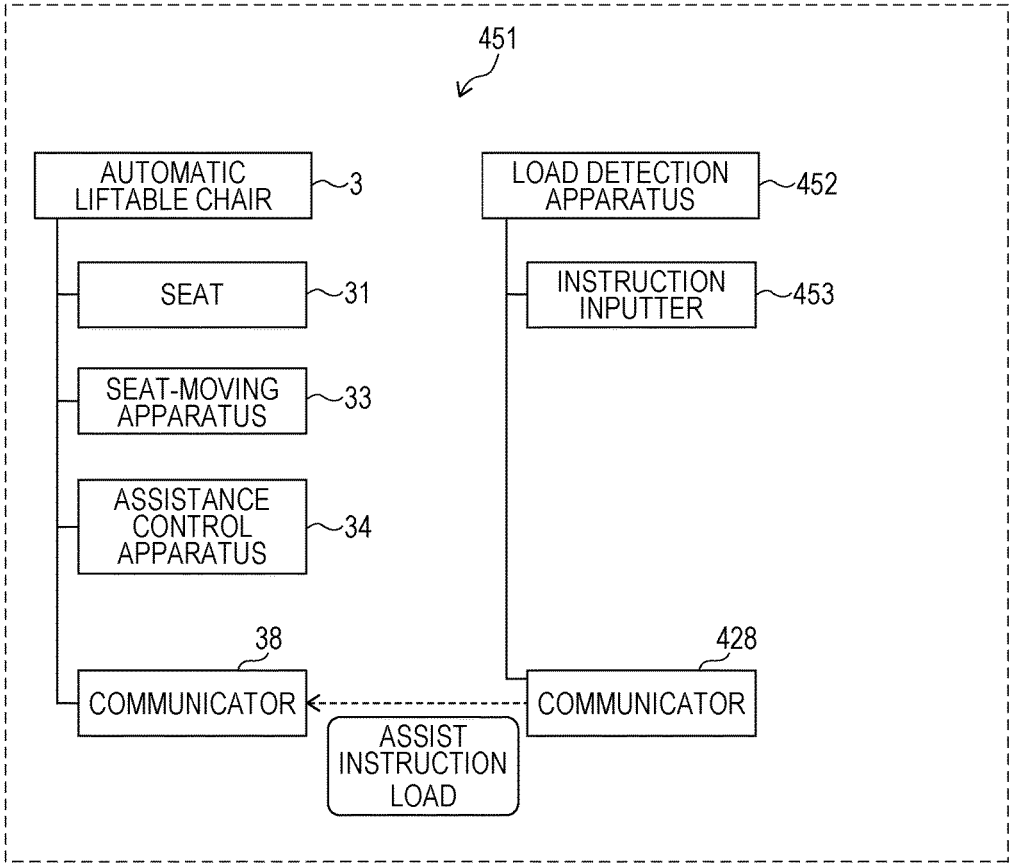
FIG. 36 is a control block diagram of a life assistance system of Embodiment 17 of the present disclosure.

As shown in FIG. 36, the life assistance system 451 of Embodiment 17 includes an automatic liftable chair 3, a load detection apparatus 452 that detects a load applied by a user's hand or arm, and an instruction inputter 453 that receives a stand-up assist instruction from the user.

The load detection apparatus 452 includes a support structure that supports the user's body by receiving the load applied by the user's hand or arm and a load detector provided in the support structure to detect a load applied to the support structure. Such a support structure may for example be a stick, or may be an elbow rest provided as part of the automatic liftable chair 3. That is, the support structure may be a structure provided as part of the chair 3, or may be an independent structure that is separate from the chair 3. The load detector may for example be a force sensor.

The instruction inputter 453 is provided, for example, in the support structure (such as a stick or an elbow rest) of the load detection apparatus 452. It should be noted that, instead of being provided in the load detection apparatus 452, the instruction inputter 453 may be separate from the load detection apparatus 452.

Furthermore, the load detection apparatus 452 is provided with a communicator 428 that sends information such as the load to the automatic liftable chair 3 through the network.

In the life assistance system 451 of Embodiment 17, the inputting of an assist instruction from the user to the instruction inputter 453 causes the instruction inputter 453 to notify the communicator 428 to that effect, and the communicator 428 notifies the communicator 38 of the chair 3 through the network of reception information indicating that the assist instruction has been received. Upon receiving the reception information from the communicator 38, the assistance control apparatus 34 in the chair 3 controls the seat 31 so that the seat 31 moves from the sitting position to the first seat position (first assisting action).

Next, upon detecting the load applied by the user's hand or arm, the load detection apparatus 452 notifies the assistance control apparatus 34 of the chair 3 of load detection information via the communicators 428 and 38 to that effect. Upon receiving this notification, the assistance control apparatus 34 controls the seat 31 so that the seat 31 moves from the first seat position to the second seat position (second assisting action).

The life assistance system 451 of Embodiment 17 makes it possible to, by using the support structure, such as a stick or an elbow rest, instead of an autonomous mobile robot to detect the load of the user, assist the user in the act of standing up.

It should be noted that a proper combination of any of the various embodiments described above can bring about the respective effects of the embodiments combined.

The present disclosure is fully described in association with preferred embodiments with reference to the accompanying drawings; however, various alterations and modifications are apparent to those who are skilled in this technical field. Such alterations and modifications should be understood as being encompassed in the scope of the present disclosure as set forth in the accompanying claims, provided such alterations and modifications do not depart therefrom.

A life assistance system according to the present disclosure is configured such that at a stage where a user is mentally and physically prepared, an automatic liftable chair assists, in two stages, the user in the act of standing up, thus making it possible to produce a sense of security in the user. The life assistance system is usefully applicable to a user who needs assistance in the act of standing up, such as an elderly person.

What is claimed is:

1. A life assistance system comprising:

an automatic liftable chair having a seat on which a user sits and an assistance control apparatus;

an autonomous mobile robot connected to the automatic liftable chair via a network, the autonomous mobile robot being configured to detect a load applied by a hand or an arm of the user, the autonomous mobile robot including:

a main body;

a handle, provided on the main body, which is able to be gripped by the user;

a first load sensor configured to detect, as the load applied by the hand or the arm of the user, the load applied to the handle; and an instruction inputter configured to receive a stand-up assist instruction from the user, wherein the assistance control apparatus is configured to control a movement of the seat to execute an assisting action of assisting the user, who is sitting on the automatic liftable chair, in standing up, in response to the stand-up assist instruction, the assistance control apparatus executes a first assisting action of moving the seat from a sitting position to a first seat position, and upon detection of the load, the assistance control apparatus executes a second assisting action of moving the seat from the first seat position to a second seat position.

2. The life assistance system according to claim 1, wherein the autonomous mobile robot sends reception information and load detection information to the automatic liftable chair via the network, the reception information indicating that the stand-up assist instruction has been received, the load detection information indicating that the load has been detected, the automatic liftable chair receives the reception information and the load detection information via the network, in a case where the reception information has been received by the automatic liftable chair, the assistance control apparatus executes the first assisting action, and in a case where the load detection information has been received by the automatic liftable chair, the assistance control apparatus executes the second assisting action.

3. The life assistance system according to claim 2, wherein the automatic liftable chair further includes a second load sensor configured to detect a second load applied to the seat, and the assistance control apparatus executes the second assisting action in the case where both (i) the load detection information has been received by the automatic liftable chair and (ii) a decrease in the second load applied to the seat has been detected.

4. The life assistance system according to claim 2, wherein the autonomous mobile robot is configured to cause the main body to move in a self-supporting state, and upon receiving the stand-up assist instruction via the instruction inputter, the autonomous mobile robot is configured to cause the autonomous mobile robot to move to an assisting place in an area near a place that is in front of the automatic liftable chair.

5. The life assistance system according to claim 2, wherein the assisting action includes at least an action of changing a seat angle formed by a front-back direction of the seat and a vertical direction, the first assisting action changes the seat angle from a steady seat angle corresponding to the sitting position to a first seat angle corresponding to the first seat position, the second assisting action changes the seat angle from the first seat angle to a second seat angle corresponding to the second seat position, and the first seat angle lies between the steady seat angle and the second seat angle.

6. The life assistance system according to claim 2, wherein the automatic liftable chair further includes at least a footrest on which a foot of the user is placed or a leg rest that guides a leg of the user, and the sitting position is a seat position in which, when the user is using at least the footrest or the leg rest, a knee joint of the user is at an angle of greater than 90 degrees.

7. The life assistance system according to claim 6, wherein the assisting action at least displaces the seat in a front-back direction of the automatic liftable chair, and the first assisting action displaces the seat from the sitting position to the first seat position, the first seat position being closer to a front of the automatic liftable chair than the sitting position.

8. The life assistance system according to claim 2, wherein the automatic liftable chair further includes:

a vital sign information sensor that detects vital sign information on the user sitting on the automatic liftable chair, the automatic liftable chair determines a degree of wakefulness of the user on a basis of the vital sign information, and the assistance control apparatus controls a speed of movement of the seat according to the degree of wakefulness.

9. The life assistance system according to claim 2, wherein the automatic liftable chair further includes:

a vital sign information sensor that detects vital sign information on the user sitting on the automatic liftable chair, the automatic liftable chair determines a degree of fatigue of the user on a basis of the vital sign information, and the assistance control apparatus controls a speed of movement of the seat according to the degree of fatigue.

10. The life assistance system according to claim 8, wherein, in a case where the vital sign information has an intensity of a predetermined value or larger, the assistance control apparatus starts to execute the first assisting action without receiving the reception information.

11. The life assistance system according to claim 8, wherein the automatic liftable chair, in a case where the degree of wakefulness is lower than a predetermined value and in a case where the first assisting action is being executed, outputs a sound that induces the user into wakefulness.

12. The life assistance system according to claim 4, wherein the automatic liftable chair acquires a time of action required to complete the first assisting action at a predetermined seat movement speed, the autonomous mobile robot calculates a route of movement and a time of movement to the assisting place, the autonomous mobile robot sends time-of-movement information to the automatic liftable chair via the network, the time-of-movement information indicating the time of movement, upon receiving the time-of-movement information via the network, the assistance control apparatus compares the time of movement with a first time of action required to complete the first assisting action at a first seat movement speed and, when the time of action is shorter than the time of movement, executes the first assisting action at a second seat movement speed that is slower than the first seat movement speed, and a second time of action required to complete the first assisting action at the second seat movement speed is equal to the time of movement.

13. The life assistance system according to claim 4, wherein the autonomous mobile robot calculates a route of movement to the assisting place and a time of movement required to move through the route of movement at a predetermined speed of movement, the automatic liftable chair acquires a time of action required to complete the first assisting action, the automatic liftable chair sends time-of-action information to the autonomous mobile robot via the network, the time-of-movement information indicating the time of action, upon receiving the time-of-action information via the network, the autonomous mobile robot compares the time of action with the time of movement required to move through the route of movement at the predetermined speed of movement and, when there is a difference between the time of action and the time of movement, causes the autonomous mobile robot to move at a second speed of movement different than the predetermined speed of movement, and a second time of movement required to move through the route of movement at the second speed of movement is equal to the time of action.

14. The life assistance system according to claim 2, wherein the autonomous mobile robot further includes a light emitter provided in the main body, and in a case where the first assisting action has been executed, the automatic liftable chair sends, to the autonomous mobile robot, a command that causes the light emitter to emit light.

15. The life assistance system according to claim 14, wherein the autonomous mobile robot determines which surface of the main body faces the automatic liftable chair, the autonomous mobile robot further includes a plurality of light emitters provided on front and back surfaces, respectively, of the main body, and in a case where the command has been received by the autonomous mobile robot, light is emitted by one of the plurality of light emitters which corresponds to the surface of the main body which faces the automatic liftable chair.

16. The life assistance system according to claim 2, wherein the autonomous mobile robot further includes a light emitter provided in the handle, and in a case where the first assisting action has been completed, the automatic liftable chair sends, to the autonomous mobile robot, a command that causes the light emitter to emit light.

17. An automatic liftable chair which is connected to an autonomous mobile robot via a network and which has and moves a seat on which a user sits, the automatic liftable chair comprising:

a communicator configured to receive reception information and load detection information from the autonomous mobile robot via the network, the reception information indicating that a stand-up assist instruction has been received, the load detection information indicating that a load applied to the autonomous mobile robot has been detected; and an assistance control apparatus configured to control the seat to execute an assisting action of assisting the user, who is sitting on the automatic liftable chair, in standing up, wherein in a case where the reception information has been received by the communicator, the assistance control apparatus is configured to execute a first assisting action of moving the seat from a sitting position to a first seat position, and in a case where the load detection information has been received by the communicator, the assistance control apparatus is configured to execute a second assisting action of moving the seat from the first seat position to a second seat position.

18. A life assistance method for use in an automatic liftable chair which is connected to an autonomous mobile robot via a network and which has and moves a seat on which a user sits, the life assistance method comprising:

receiving reception information and load detection information from the autonomous mobile robot via the network, the reception information indicating that a stand-up assist instruction has been received, the load detection information indicating that a load applied to the autonomous mobile robot has been detected;

controlling the seat to execute an assisting action of assisting the user, who is sitting on the automatic liftable chair, in standing up;

upon receiving the reception information, executing a first assisting action of moving the seat from a sitting position to a first seat position; and upon receiving the load detection information, executing a second assisting action of moving the seat from the first seat position to a second seat position.

19. The life assistance system according to claim 1, wherein the instruction inputter includes at least one of a microphone, a button, or a camera.

* * * * *